US011230397B2

(12) United States Patent
Mondini et al.

(10) Patent No.: US 11,230,397 B2
(45) Date of Patent: Jan. 25, 2022

(54) APPARATUS AND METHOD FOR PACKAGING A PRODUCT

(71) Applicants: Cryovac, LLC, Charlotte, NC (US); Paolo Mondini, Cologne (IT); Stefano Barbariga, Cologne (IT)

(72) Inventors: Paolo Mondini, Cologne (IT); Stefano Barbariga, Cologne (IT); Maurizio Ciocca, Novara (IT)

(73) Assignee: CRYOVAC, LLC, Charlotte, NC (US)

( * ) Notice: Subject to any disclaimer, the term of this patent is extended or adjusted under 35 U.S.C. 154(b) by 85 days.

(21) Appl. No.: 16/339,882

(22) PCT Filed: Oct. 13, 2017

(86) PCT No.: PCT/IB2017/056353

§ 371 (c)(1),
(2) Date: Apr. 5, 2019

(87) PCT Pub. No.: WO2018/069880

PCT Pub. Date: Apr. 19, 2018

(65) Prior Publication Data

US 2019/0241296 A1 Aug. 8, 2019

(30) Foreign Application Priority Data

Oct. 14, 2016 (IT) ..... 102016000103666

(51) Int. Cl.
*B65B 11/00* (2006.01)
*B65B 31/08* (2006.01)
(Continued)

(52) U.S. Cl.
CPC ..... *B65B 31/08* (2013.01); *B65B 11/52* (2013.01); *B65B 55/18* (2013.01); *B65D 75/305* (2013.01); *B65D 81/2038* (2013.01)

(58) Field of Classification Search
CPC ..... B65B 31/00; B65B 31/08; B65B 11/52
See application file for complete search history.

(56) References Cited

U.S. PATENT DOCUMENTS 4,162,599 A * 7/1979 Kyle ..... B65B 31/043 53/511
5,025,611 A * 6/1991 Garwood ..... B65B 11/50 53/509

(Continued)

FOREIGN PATENT DOCUMENTS

EP 2722279 A1 * 4/2014 ..... B65D 75/305
EP 2722279 A1 4/2014

(Continued)

*Primary Examiner* — Eyamindae C Jallow
(74) *Attorney, Agent, or Firm* — Moore & Van Allen PLLC

(57) ABSTRACT

An apparatus can be used for packaging a product. The apparatus includes a frame, a conveyor, and a packaging station. The packaging station receives a support at a respective positioning seat, receives a portion of a film above the support so that, between the support and the film portion, a reception volume is defined, and sealingly constrains the film portion to the support. The packaging station comprises a penetrating tool having a first through opening and a second through opening. The penetrating tool is arranged in an advanced position in which a part of the tool crosses the support arranged in the positioning seat, accessing the reception volume. At the advanced position, the first through opening is arranged at least partly in the reception volume, beyond the base wall or beyond the lateral wall and the second through opening is arranged astride the base wall or the lateral wall.

13 Claims, 20 Drawing Sheets

(51) Int. Cl.

| | |
|---|---|
| ***B65B 11/52*** | (2006.01) |
| ***B65D 75/30*** | (2006.01) |
| ***B65D 81/20*** | (2006.01) |
| ***B65B 55/18*** | (2006.01) |

(56) References Cited

U.S. PATENT DOCUMENTS

| | | | | |
|---|---|---|---|---|
| 5,419,101 | A * | 5/1995 | Gorlich | B65B 31/04 53/510 |
| 5,491,957 | A | 2/1996 | Maskell | |
| 10,259,603 | B2 * | 4/2019 | Palumbo | B65B 61/06 |
| 10,358,240 | B2 * | 7/2019 | Scrivani | B65B 7/01 |
| 10,926,904 | B2 * | 2/2021 | Rizzi | B29C 66/8181 |
| 2006/0147588 | A1 * | 7/2006 | Garwood | B65D 81/2076 426/392 |
| 2006/0191594 | A1 | 8/2006 | Py | |
| 2012/0204516 | A1 * | 8/2012 | Palumbo | B65B 41/06 53/403 |
| 2013/0016924 | A1 | 1/2013 | Helmsderfer et al. | |
| 2019/0241296 | A1 * | 8/2019 | Mondini | B65D 81/2038 |
| 2019/0351456 | A1 * | 11/2019 | Palumbo | B65B 65/006 |

FOREIGN PATENT DOCUMENTS

| | | | | |
|---|---|---|---|---|
| GB | 1416101 | A | 12/1975 | |
| WO | WO-2014166940 | A1 * | 10/2014 | B29C 65/7847 |

* cited by examiner

FIG.5C
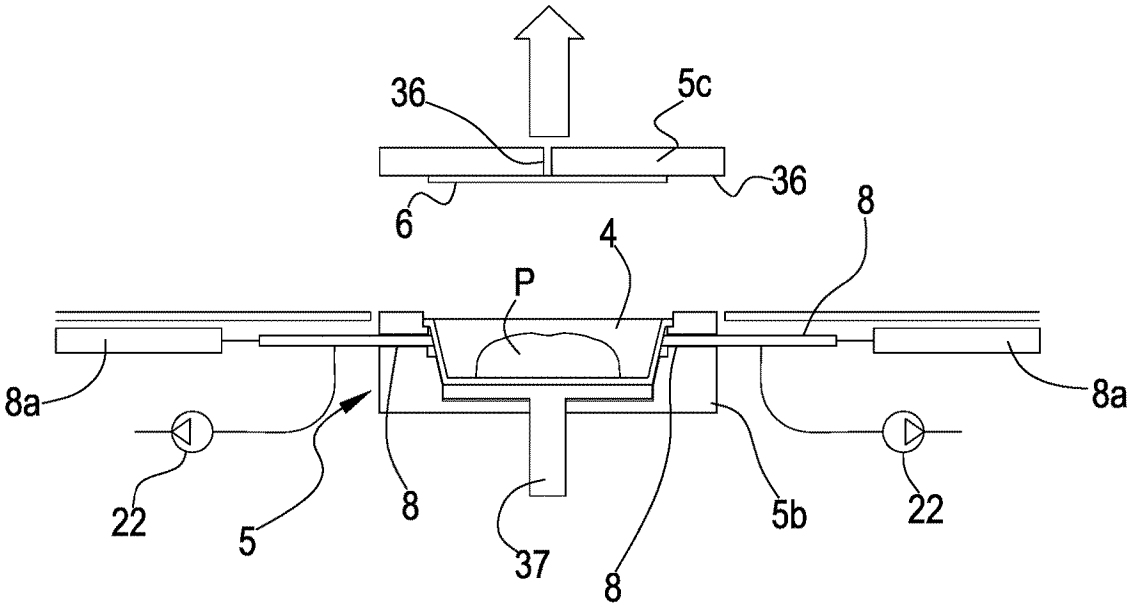
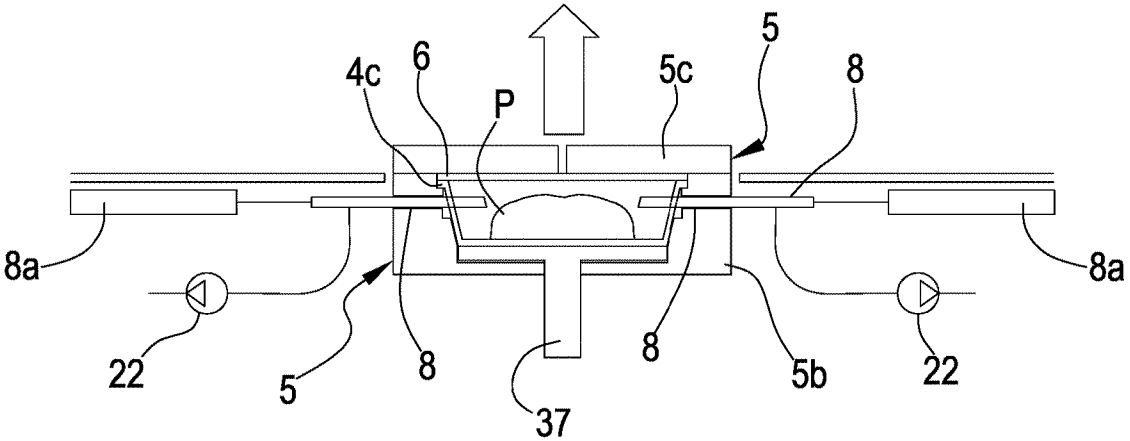
FIG.5D

APPARATUS AND METHOD FOR PACKAGING A PRODUCT

FIELD OF THE INVENTION

The present invention regards an apparatus and a method for packaging a product, in particular for vacuum packaging or packaging in controlled atmosphere.

STATE OF THE ART

Apparatuses and relative methods for packaging products are known in the field of packaging. Among the packaging processes, processes are known which make packages by means of plastic films for closing foods such as meat and fish to be frozen, cheese, treated meat, ready-to-eat meals and similar foods. One type of vacuum packages, closed by means of plastic films, is described for example in the following patents: FR1258357, FR1286018, AU3491504, U.S. RE30,009, U.S. Pat. Nos. 3,574,642, 3,681,092, 3,713,849, 4,055,672 and 5,346,735.

The vacuum packaging process is essentially a thermoforming process which provides for arranging a (food) product inside a rigid or semi-rigid support, for example a tray, a basin or a cup made of plastic material. The support and the relative product are arranged inside a vacuum chamber. Inside the chamber, a thermoplastic film is welded to an upper edge of the support; subsequently the air present in the package is extracted so that the thermoplastic film can adhere to the product arranged inside the support.

Hereinbelow, several examples are reported of machines and relative processes for vacuum packaging products.

The U.S. Pat. No. 3,481,101 describes a method for making a package comprising, in a first embodiment, a tray with square base provided with lateral walls—with substantially vertical extension emerging from the base—and upper edge portions emerging from the lateral walls in a direction that is exiting with respect to the tray. The tray is provided with a plurality of openings with closed profile defined at the lateral walls of the tray. The method provides for positioning a product inside the tray and the subsequent sealed closure thereof by means of a heated film. Following the positioning of the film, the method provides for applying the vacuum inside the package through the plurality of openings in a manner such that the film is adapted for the product arranged inside the tray and then defines the sealing thereof.

The U.S. Pat. No. 3,481,101 also describes, in a second embodiment, a method for making a package comprising a first film made of plastic film adapted to receive a product in abutment; the first film has a plurality of openings with closed profile arranged around the product. The method provides for positioning a product on the first film and the subsequent sealed closure thereof by means of a second film. Following the joining of the two films, the method provides for applying the vacuum inside the package through the plurality of openings of the first film such that the two films are adapted to the product and then define the sealing of the package.

In both embodiments described in the U.S. Pat. No. 3,481,101, the method provides for removing the air from inside the package due to a series of channels communicating with the openings present on a support element or on a film.

The solution described in the US application however allows the extraction of a limited quantity of air; the film—attracted in the direction of the product following the vacuum application—immediately occludes the openings, preventing the removal of the desired air quantity. Such problem is more felt in the use of deeper trays with high depth and/or of products with irregular shape; in such cases, actual air sacs of considerable size are formed inside the package.

An excessive residual air quantity present in the packages can degrade the packaged product or at least negatively affect the expiry date of the product itself. It is also to be indicated that the presence of air can negatively affect the aesthetics of the package and hence the consumer's impression of the pack.

Further examples of trays with pre-fabricated holes are known from the documents U.S. Pat. No. 4,919,955, WO9714313 and US2005074531. The holes present on the trays described in U.S. Pat. No. 4,919,955 and US2005074531 are also provided with a valve means. A further example—described in the application No. EP2722279A1 by the same Applicant—provides for a method and a relative apparatus for the vacuum packaging of products arranged on a perforated support. In particular, the solution described in the European patent application No. EP2722279A1 provides for making a hole on the support by means of a perforating needle. The needle is provided with an internal channel by means of which the extraction of air in the support is executed, following the sealed heat-welding of a plastic film on the same support.

The use of a needle directly insertable in the package allows an improved extraction of air with respect to the preceding abovementioned solutions.

Even if the solution described in the European patent application No. EP2722279A1—improved with respect to the present solutions—allows the extraction of air from the package for making a vacuum packaged product, the Applicant has indicated that also that described in European application No. EP2722279A1 can be improved with regard to various aspects.

OBJECT OF THE INVENTION

Object of the present invention is therefore that of substantially resolving at least one of the drawbacks and/or limitations of the preceding solutions.

A first object of the invention is to provide a packaging apparatus and method capable of efficiently removing air from a package or capable of defining an optimal controlled atmosphere inside the package without negatively affecting the plant and process costs.

A further object of the present invention is to provide a vacuum packaging apparatus and method capable of ensuring reduced air extraction times and hence such to allow making packaged products, in particular vacuum-packaged, with limited production costs.

Then, one object of the present invention is to provide an apparatus and method for packaging—vacuum or at controlled atmosphere—that can be actuated without requiring complex modifications to the conventional packaging systems.

Another auxiliary object is to provide a packaging apparatus and method capable of safely operating and in particular reaching the objective of removing the air or generating controlled atmosphere without compromising the appearance of the packaged final product.

These objects and still others, which will be clearer in the following description, are substantially reached by a packaging apparatus and method in accordance with that expressed in one or more of the enclosed claims and/or of the following aspects, taken on their own or in any combination with each other or in combination with any one of the enclosed claims and/or in combination with any one of the further aspects or characteristics described hereinbelow.

SUMMARY

Aspects of the invention are described hereinbelow.

In a 1st aspect, an apparatus is provided for packaging (1) a product (P) arranged on a support (4), said apparatus (1) comprising:

a frame (2), a conveyor (3) engaged to the frame (2) and configured to move one or more supports (4) along a pre-set advancement path (A), a packaging station (5) configured for:

receiving at least one support (4) at a respective positioning seat (5*a*), said support (4) having at least one base wall, and optionally at least one lateral wall emerging from the base wall, receiving at least one portion of a film (6) above said at least one support so that, between said support and said film portion, a reception volume is defined for said product (P), sealingly constraining the film portion (6) to said support (4), said packaging station (5) comprising at least one penetrating tool (8) having at least one first through opening and at least one second through opening distinct and separate from each other.

In a 2nd aspect in accordance with the preceding aspect, the penetrating tool (8) is configured to be arranged in at least one advanced position in which a part of the tool (8) crosses the base wall or the lateral wall of a support (4) arranged in said positioning seat (5*a*), accessing said reception volume for the product.

In a 3rd aspect in accordance with the preceding aspect, wherein—at the advanced position—the penetrating tool (8) has:

the first through opening arranged at least partly in the reception volume for the product, beyond said base wall or beyond said lateral wall, the second through opening arranged astride said base wall or said lateral wall.

In a 4th aspect in accordance with the 2nd or 3rd aspect, the second through opening (11*b*)—in the advanced position of the penetrating tool (8)—partly extends into the reception volume, beyond said base wall or beyond said lateral wall, and partly outside said reception volume.

In a 5th aspect in accordance with any one of the preceding aspects, the penetrating tool (8) comprises a distal portion (9) at which the first and the second through opening (11*a*, 11*b*) are defined.

In a 6th aspect in accordance with the preceding aspect, wherein the distal portion—in the advanced position of the penetrating tool (8)—is suitable to be arranged at least partly in the reception volume.

In a 7th aspect in accordance with the 5th or 6th aspect, the distal portion (9) has a shape extended along a main extension direction.

In an 8th aspect in accordance with any one of the aspects from the 5th to the 7th, the distal portion (9) comprises:

a front portion (10), a rear portion (12), an intermediate portion (11) interposed between the front portion and the rear portion (10, 12).

In a 9th aspect in accordance with the preceding aspect, wherein—when the penetrating tool (8) is in advanced position—the front portion (10) is arranged in the reception volume while the intermediate portion (11) is arranged astride said base wall or said lateral wall.

In a 10th aspect in accordance with the 8th or 9th aspect, the intermediate portion (11)—in the advanced position of the penetrating tool (8)—is partly arranged in the reception volume, beyond said base wall or beyond said lateral wall, and partly outside said reception volume.

In an 11th aspect in accordance with any one of the aspects from the 8th to the 10th, the intermediate portion (11)—when the penetrating tool (8) is in advanced position—has a central zone arranged at said base wall or said lateral wall of the support (4).

In a 12th aspect in accordance with any one of the aspects from the 8th to the 11th, the second through opening (11*b*) extends at least partly on said intermediate portion (11).

In a 13th aspect in accordance with any one of the aspects from the 8th to the 12th, the second through opening (11*b*) extends over the entire longitudinal extension of the intermediate portion (11) and along at least part of the entire longitudinal extension of the front portion (10).

In a 14th aspect in accordance with any one of the aspects from the 8th to the 13th, the first through opening (11*a*) extends along the entire longitudinal extension of the front portion (10) and of the intermediate portion (11).

In a 15th aspect in accordance with any one of the preceding aspects, the first through opening (11*a*) has a closed continuous edge.

In a 16th aspect in accordance with the preceding aspect, the closed continuous edge comprises:

a first section defining a cutting end, with a single tip or multiple tips, of the front portion, a second and a third section, mutually parallel and emerging from ends of the first section, a fourth section transverse to the second and third section which connects ends of the second and third sections axially opposed to the first section, said sections conferring to the closed continuous edge a shape that is non-planar and extended along the longitudinal extension of the penetrating tool.

In a 17th aspect in accordance with the 15th or 16th aspect, the first through opening (11*a*) is defined by a single opening perimetrically delimited by the closed continuous edge.

In an 18th aspect in accordance with any one of the aspects from the 8th to the 17th, the front portion (10) and the intermediate portion (11) are joined as a single piece and are arranged one immediately after the other according to the main extension direction of the distal portion (9).

In a 19th aspect in accordance with any one of the preceding aspects, the second through opening (11*b*) is defined by a single opening perimetrically delimited by a single closed continuous edge.

In a 20th aspect in accordance with any one of the aspects from the 8th to the 19th, the intermediate portion (11) has—according to a section defined at the first through opening (11*a*) and transverse to the main extension direction of the distal portion (9)—an open profile, optionally C-shaped or U-shaped.

In a 21st aspect in accordance with any one of the preceding aspects, the first and the second through opening (11*a*, 11*b*) are arranged on mutually opposed sides of the penetrating tool (8).

In a 22nd aspect in accordance with any one of the preceding aspects, the second through opening (11*b*) has an elongated-shaped closed continuous edge.

In a 23rd aspect in accordance with any one of the aspects from the 7th to the 22nd, the second opening has a substantially elliptical elongated shape extending parallel to the main extension direction of the distal portion (9).

In a 24th aspect in accordance with any one of the aspects from the 8th to the 23rd, the intermediate portion (11) comprises:

a base (13), optionally flat, a first and a second lateral wall (14, 15) emerging from the base (13) starting from opposite perimeter edges of the latter, said first and second lateral walls (14, 15) being connected to each other exclusively by means of said base (13), and wherein the first and the second lateral walls (14, 15) have—on the opposite side with respect to the base (13)—respective free edges (14*a*, 15*a*) at least partly delimiting the first through opening (11*a*).

In a 25th aspect in accordance with the preceding aspect, the first lateral wall (14) and the second lateral wall (15) emerge from the base (13) and extend from the latter for a same height (h).

In a 26th aspect in accordance with the 24th or 25th aspect, the base (13) of the intermediate portion (11) is flat.

In a 27th aspect in accordance with the preceding aspect, the free edges of the first and second lateral walls (14, 15) are defined on a single plane parallel to the base (13).

In a 28th aspect in accordance with any one of the aspects from the 24th to the 27th, the free edges of the first and second lateral walls (14, 15) extend along respective directions parallel to each other.

In a 29th aspect in accordance with the preceding aspect, the free edges of the first and second lateral wall (14, 15) extend along respective directions parallel to the main extension direction of the distal portion (9), to define said second and third sections of the closed continuous edge of the first through opening (11*a*).

In a 30th aspect in accordance with any one of the aspects from the 24th to the 29th, the first lateral wall (14) of the intermediate portion (11) has—according to a section transverse to the main extension direction of the distal portion (9)—an arched profile, wherein the second lateral wall (15) of the intermediate portion (11) has—according to a section transverse to the main extension direction of the distal portion (9)—an arched profile, the concavities defined by the respective first and second lateral walls (14, 15) facing each other.

In a 31st aspect in accordance with any one of the aspects from the 24th to the 30th, the second through opening (11*b*) is defined on the base (13) of the intermediate portion (11).

In a 32nd aspect in accordance with any one of the aspects from the 24th to the 31st, the base (13) of the intermediate portion (11) is flat and has a substantially rectangular shape.

In a 33rd aspect in accordance with any one of the aspects from the 24th to the 32nd, the second through opening (11*b*) extends along the entire extension of the base (13) of the intermediate portion (11) according to the main extension direction of the distal portion (9).

In a 34th aspect in accordance with any one of the aspects from the 2nd to the 33rd, the penetrating tool (8) is movable relative to the positioning seat (5*a*) of the same packaging station (5) between:

a receded position in which the penetrating tool (8) is arranged outside the reception volume spaced from or in contact with the base wall or said lateral wall of the support (4), the advanced position.

In a 35th aspect in accordance with any one of the aspects from the 5th to the 34th, the distal portion (9) comprises a free cutting edge (16) configured to enable the perforation of said base wall or said lateral wall of the support (4).

In a 36th aspect in accordance with the preceding aspect, the free cutting edge (16) is configured to enable the perforation of the support (4) during the relative movement of the tool (8), with respect to the positioning seat (5*a*), from the receded position to the advanced position, defining a hole (4*d*) on said support (on the base wall and/or on the lateral wall of the support 4).

In a 37th aspect in accordance with the 35th or 36th aspect, the free cutting edge (16) is defined at said first section of the closed continuous edge.

In a 38th aspect in accordance with any one of the aspects from the 35th to the 37th, the free cutting edge (16) defines an open profile connected without interruption to the second and third section.

In a 39th aspect in accordance with any one of the aspects from the 35th to the 38th, the free cutting edge (16) is defined exclusively on the front portion (10) of the distal portion (9).

In a 40th aspect in accordance with any one of the aspects from the 16th to the 39th, the second and third section of the closed continuous edge are not sharp/cutting.

In a 41st aspect in accordance with any one of the aspects from the 8th to the 40th, the front portion (10) comprises a base (17), optionally flat.

In a 42nd aspect in accordance with the preceding aspect, the base (17) of the front portion (10) is joined in a single piece to the base (13) of the intermediate portion (11) and emerges without interruption from the latter base (13).

In a 43rd aspect in accordance with the 41st or 42nd aspect, the base (17) of the front portion (10) is terminally delimited by an end part of the free cutting edge (16).

In a 44th aspect in accordance with the preceding aspect, the end part of the base (17) of the front portion (10) has a shape substantially V-shaped, C-shaped or U-shaped.

In a 45th aspect in accordance with any one of the aspects from the 41st to the 44th, the front portion (10) comprises a first lateral cutting wall (18) and a second lateral cutting wall (19) opposite each other and emerging from the base (17) of the same front portion (10).

In a 46th aspect in accordance with the preceding aspect, said first and second lateral cutting wall (18, 19) are joined as a single piece respectively as a continuation of the first and second lateral wall (14, 15) of the intermediate portion (11).

In a 47th aspect in accordance with the 45th or 46th aspect, the first and the second lateral cutting wall (18, 19) are joined as a single piece to the base (17), optionally flat, of the front portion (10).

In a 48th aspect in accordance with any one of the aspects from the 45th to the 47th, wherein the base (17), the first lateral cutting wall (18) and the second lateral cutting wall (19) define—according to a view along the main extension direction of the distal portion (9)—a shape with substantially C-shaped or substantially U-shaped open profile.

In a 49th aspect in accordance with any one of the aspects from the 45th to the 48th, the free cutting edge (16) delimits, without interruption, the first lateral cutting wall (18), the base (17) and the second lateral cutting wall (19) of the front portion (10).

In a 50th aspect in accordance with any one of the aspects from the 35th to the 49th, the free cutting edge (16) is joined without interruption to the respective free edges of the first and the second lateral wall (14, 15) of the intermediate portion (11).

In a 51st aspect in accordance with any one of the aspects from the 45th to the 50th, the free cutting edge (16) delimits the first and the second lateral cutting walls (18, 19).

In a 52nd aspect in accordance with any one of the aspects from the 45th to the 51st, the free edges of the first and second lateral wall (14, 15) of the intermediate portion (11) are arranged at a pre-set distance (d) smaller than a maximum distance (w) between the free cutting edges of the first and second lateral cutting walls (18, 19) of the front portion (10).

In a 53rd aspect in accordance with any one of the preceding aspects, the apparatus comprises at least one actuator (8*a*) connected to the penetrating tool (8) and configured for moving the latter along a pre-set trajectory intersecting the support (4) when the latter is retained in the positioning seat (5*a*).

In a 54th aspect in accordance with the preceding aspect, the actuator is configured to move the penetrating tool (8) between the receded position and the advanced position, and vice versa.

In a 55th aspect in accordance with any one of the preceding aspects, the packaging station (5) is configured for sealingly constraining, optionally by means of heat-welding, the film portion (6) to the support (4) in order to define a housing chamber (C) for the product (P).

In a 56th aspect in accordance with any one of the preceding aspects, the apparatus (1) comprises a suctioning system (21) associated with the penetrating tool (8), said suctioning system (21) being configured for removing air from the packaging station.

In a 57th aspect in accordance with the preceding aspect, the suctioning system (21) is configured for removing air—through the first and second through opening (11*a*, 11*b*) in the advanced position of the penetrating tool (8)—from said housing chamber (C).

In a 58th aspect in accordance with any one of the preceding aspects the packaging station (5) comprises:

a lower tool (5*b*) defining said positioning seat (5*a*) and configured for receiving one or more supports (4), an upper tool (5*c*), wherein the upper tool and lower tools are movable with respect to each other between at least one first operating condition, at which the lower tool and the upper tool are spaced from each other so as to enable the introduction of the film portion (6) and of the support (4) in the packaging station (5), and at least one second operating condition, at which the lower tool and upper tool are brought close to each other and define a fluid-tight closed packaging chamber (T), wherein the penetrating tool (8) is associated with the packaging station (5) and it is suitable to operate inside said housing chamber (T).

In a 59th aspect in accordance with the preceding aspect, the suctioning system (21) comprises:

at least one vacuum pump (22), at least one suctioning channel (23) suitable to place the vacuum pump in fluid communication with the fluid-tight chamber definable by the packaging station (5), wherein the first and the second through opening (11*a*, 11*b*)—at least in the advanced position condition of the penetrating tool (8) and in the second operating condition of the packaging station (5)—are in direct fluid communication with the housing chamber (T) and hence—through the suctioning channel (23)—with the vacuum pump (22), the vacuum pump (22) being configured to enable the removal of air in the housing chamber (C) for the product (P)—through the first and second through opening (11*a*, 11*b*)—by means of air suction from the housing chamber (T) of the packaging station (5).

In a 60th aspect in accordance with the 58th or 59th aspect, the apparatus (1) comprises at least one control unit (24) connected to the packaging station (5) and to the penetrating tool (8), said control unit (24) being configured to:

control the positioning of the penetrating tool (8) in the advanced position, control the packaging station for sealingly constraining the film portion (6) to the respective support (4), control the suctioning system (21) in order to determine the removal of air from the housing chamber (C).

In a 61st aspect in accordance with the preceding aspect, the control unit (24) is configured for controlling the suctioning system (21) to continuously remove air—through the first and the second through opening of the penetrating tool (8)—also following the sealing constraint of the film portion (6) on the support (4).

In a 62nd aspect in accordance with the 60th or 61st aspect, the control unit (24) is also configured to:

control the movement of the upper tool and lower tool in approaching each other in order to define the second operating condition, subsequently, control the suctioning system (21) to remove at least part of the air present inside the housing chamber (T) in order to therein define a pressure lower than the atmospheric pressure, control the packaging station (5) to sealingly constrain the film portion (6) on the support (4), following the sealing constraint, control the continuous removal of air from the housing chamber (T).

In a 63rd aspect in accordance with any one of the aspects from the 60th to the 62nd, the control unit (24)—following control of extraction of air from the housing chamber (5)—is also configured to:

control the penetrating tool (8) to move from the advanced position to the receded position, enabling the film portion (6) to adhere to a surface of said perforated lateral wall or base wall, hermetically sealing said hole (4*d*), bringing the upper tool and the lower tool into said first operating condition, extracting the packaged product from the packaging station (5).

In a 64th aspect in accordance with the preceding aspect, the control unit is configured to control the movement of the penetrating tool (8) from the advanced position to the receded position after a pre-set period of time from the beginning of the suctioning step or upon reaching a pre-set vacuum level in the housing chamber (5).

In a 65th aspect in accordance with the 63rd or 64th aspect, the control unit (24) is configured to control the movement of the penetrating tool (8) from the advanced position to the receded position after having controlled the sealing constraint of the film portion (6) to the perimeter edge of the support (4).

In a 66th aspect in accordance with the 63rd or 64th or 65th aspect, wherein during movement from the receded position to the advanced position the penetrating tool (8) is configured for perforating the base wall or the lateral wall of the support (4), forming at least one hole and one or more flaps (4*f*) optionally folded towards the interior of the reception volume; and wherein following the step of controlling—by the control unit—the movement of the penetrating tool (8) into the receded position, said one or more flaps (4*f*) are moved to close the hole (4*d*) and are aligned with said base wall or said lateral wall; the film portion (6) adhering to a surface of said perforated lateral wall or base wall also blocking said one or more flaps to close the hole.

In a 67th aspect, a method is provided of packaging a product (P) by means of an apparatus in accordance with any one of the preceding aspects.

In a 68th aspect in accordance with the preceding aspect, the method comprises at least the following steps:

moving one or more supports (4), on which at least one respective product (P) is placed, along the pre-set advancement path (A), up to the packaging station (5), moving at least one portion of a film (6) up to the packaging station (5), receiving at least one support (4) in the packaging station (5), at a respective positioning seat (5*a*), receiving at least one portion of a film (6) above said at least one support so that, between said support (4) and said film portion (6), a reception volume is defined where said product (P) to be packaged is located, positioning, by means of a relative movement between the penetrating tool (8) and the positioning seat (5*a*), the penetrating tool in said advanced position in which a part of the tool (8) crosses the base wall or the lateral wall of the support (4) arranged in said positioning seat (5*a*), accessing said reception volume for the product, at the advanced position the penetrating tool (8) having the first through opening (11*a*) arranged at least partly inside the reception volume for the product (P), beyond said base wall or beyond said lateral wall, the second through opening (11*b*) arranged astride said base wall or said lateral wall, extracting gas from at least said reception volume for the product (P) through said first and said second opening, sealingly constraining the film portion (6) to said support (4).

In a 69th aspect in accordance with the preceding aspect, the step of positioning the penetrating tool (8) in the advanced position comprises moving the penetrating tool from the receded position to the advanced position, during said movement the penetrating tool (8) perforating the base wall or the lateral wall of the support, forming at least one hole (4*d*) through which the penetrating tool (8) is arranged.

In a 70th aspect in accordance with the 68th or 69th aspect, the step of constraining the film portion (6) to the support (4) comprises sealingly constraining the film portion with at least one perimeter edge of the support (4) in order to define a housing chamber (C) for the product (P); and wherein the apparatus (1) comprises a suctioning system (21) associated with the penetrating tool (8), the suctioning step providing for controlling said suctioning system (21) to remove air from said housing chamber (C)—through the first and second through openings (11*a*, 11*b*)—also after having sealingly constrained the film portion to the perimeter edge of the support.

In a 71st aspect in accordance with any one of the aspects from the 68th to the 70th, the packaging station (5) comprises:

a lower tool (5*b*) defining said positioning seat (5*a*) and configured for receiving one or more supports (4), an upper tool (5*c*), wherein the upper tool and lower tool are movable with respect to each other between at least one first operating condition, at which the lower tool and the upper tool are spaced from each other so as to enable the introduction of the film portion (6) and the support (4) in the packaging station (5), and at least one second operating condition, at which the lower tool and upper tool are brought close to each other and define a fluid-tight closed packaging chamber (T), wherein the penetrating tool (8) is associated with the packaging station (5) and it is suitable to operate inside said housing chamber (T), and wherein:

the step of moving one or more supports (4) provides for positioning—with the upper tool and lower tool in said first operating condition—the one or more supports at a respective positioning seat inside the packaging station (5), the step of moving at least one portion of a film provides for positioning—with the upper tool and lower tool in said first operating condition—inside the packaging station and above the respective support, the removal step provides for removing gas from the housing chamber (T) after having brought the upper tool and lower tool into said second operating condition.

In a 72nd aspect in accordance with the 70th or 71st aspect, the suctioning system (21) comprises:

at least one vacuum pump (22), at least one suctioning channel (23) suitable to place the vacuum pump in fluid communication with the fluid-tight chamber definable by the packaging station (5), wherein the first and the second through openings (11*a*, 11*b*)—in advanced position condition of the penetrating tool (8) and in the second operating condition of the packaging station (5)—are in direct fluid communication with the packaging chamber (T) and hence—through the suctioning channel (23)—with the vacuum pump (22);

wherein the method provides for controlling the vacuum pump (22) and removing gas—through the first and second through openings (11*a*, 11*b*)—also by suctioning air from said reception volume and, upon fixing the film portion (6)—for example by means of heat-welding—to the respective support (4), from the housing chamber (C) for the product.

In a 73rd aspect in accordance with any one of the aspects from the 67th to the 72nd, the method comprises the steps of:

returning the penetrating tool (8) into the receded position, enabling the film portion to adhere to a surface of said perforated lateral wall or base wall, hermetically sealing said hole, bringing the upper tool and the lower tool into said first operating condition, extracting the packaged product from the packaging station.

In a 74th aspect in accordance with the preceding aspect, the step of returning the penetrating tool (8) into the receded position occurs in at least one of the following conditions:

after a pre-set period of time from the beginning of the suction step, upon reaching a pre-set vacuum level in the housing chamber.

In a 75th aspect in accordance with the 73rd or 74th aspect, the step of returning the penetrating tool (8) into the receded position occurs after having sealingly constrained the film portion to the perimeter edge of the support.

In a 76th aspect in accordance with the 73rd or 74th or 75th aspect, wherein during said movement from the receded position to the advanced position, the penetrating tool perforates the base wall or the lateral wall of the support, forming at least one hole and one or more flaps optionally folded towards the interior of the reception volume; and wherein following the step of returning the penetrating tool (8) into the receded position, said one or more flaps are moved to close the hole and are aligned with said base wall or said lateral wall, the film portion adhering to a surface of said perforated lateral wall or base wall also blocking said one or more flaps to close the hole.

BRIEF DESCRIPTION OF THE DRAWINGS

Some embodiments and some aspects of the invention will be described hereinbelow with reference to the enclosed drawings, provided only for indicative purposes and therefore non-limiting in which:

FIGS. 5*a* to 5*j* are further views of a packaging apparatus in accordance with the present invention schematized in different operating conditions and exemplifyingly arranged for vacuum packaging a product in a tray of the type with base, lateral wall and upper flange;

CONVENTIONS

Figure 1:
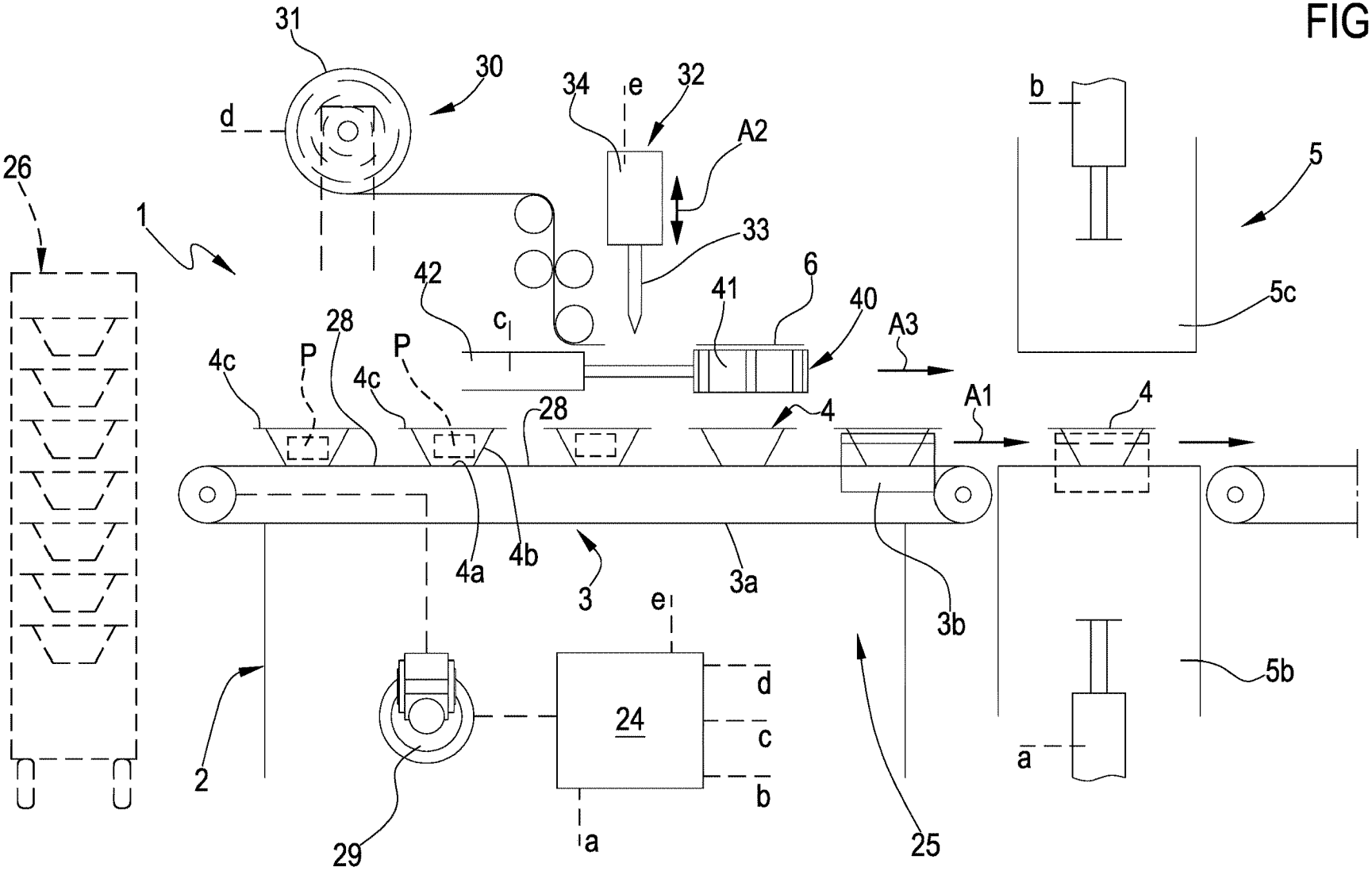
FIG. 1 is a schematic view of a packaging apparatus in accordance with the present invention in which a film is unwound from a reel and precut into a sheet outside a packaging station of the same apparatus, where the sheet of film is heat sealed on the support.

It is observed that, in the present detailed description, corresponding parts illustrated in the various figures are indicated with the same reference numbers. The figures could illustrate the object of the invention by means of representations not in scale; therefore, parts and components illustrated in the figures relative to the object of the invention may exclusively regard schematic representations.

The terms upstream and downstream, if used, refer to an advancement direction of a tray along an advancement path which extends from a starting station of the tray, through a packaging station and then up to a package unloading station.

Definitions

The Product

With the term product, it is intended an article or a composite of articles of any type. For example, the product can be of food type and be in the solid or liquid state or in gel form, i.e. in the form of two or more of the aforesaid states of aggregation. In the food field, the product can comprise meat, fish, cheese, treated meat, ready-to-eat meals and frozen food of various type.

The Control Unit

The packaging apparatus described and claimed herein comprises at least one control unit set to control the operations initiated by the apparatus. There can clearly be only one control unit or this can be formed by a plurality of separate control units depending on the design selections and on the operating needs. With the term control unit it is intended a component of electronic type which can comprise at least one of the following: a digital processor (CPU), a memory (or memories), a circuit of analogue type, or a combination of one or more digital processing units with one or more circuits of analogue type. The control unit can be "configured" or "programmed" for executing several steps: in practice this can be made with any means that allow configuring or programming the control unit. For example, in the case of a control unit comprising one or more CPUs and one or more memories, one or more programs can be stored in appropriate memory banks connected to the CPU or to the CPUs; the program or programs contain instructions which, when executed by the CPU or by the CPUs, program or configure the control unit to execute the operations described in relation to the control unit. Alternatively, if the control unit is or comprises circuitry of analogue type, then the circuit of the control unit can be designed to include circuitry configured, during use, for processing electrical signals in a manner such to execute the steps relative to the control unit.

The Support

The term support identifies both a support element that is substantially flat, in particular lacking lateral walls, adapted to essentially define a flat base for the abutment of one or more products, and a tray comprising at least one base—for example substantially flat or convex—and at least one lateral wall emerging from the external perimeter of the base to define a container that is open at least at the top; the tray defines a volume in which the product can be housed. The tray can also comprise an upper edge portion emerging radially from a free edge of the lateral wall opposite the base: the upper edge portion emerges from the lateral wall according to a direction that is exiting with respect to the volume of the tray itself. The support can have a base with perimeter having rectangular, rhomboidal, circular or elliptical form. The support can be formed by means of a specific and separate manufacturing process or it can be made in line with a packaging process (packaging process).

The support can be at least partly made of paper material. With the term paper material it is intended paper or cardboard; in particular, the sheet material usable for making the support can have a basis weight comprised between 50 and 600 g/m$^2$, in particular comprised between 100 and 500 g/m$^2$, still more particularly between 150 and 400 g/m$^2$. The paper material in question extends between a first and a second main extension surface. The sheet paper material employed for making the support can, in an embodiment variant thereof, be covered for at least one part of the first and/or second main extension surface by means of a plastic material covering, for example a film for food use. If the covering is arranged so as to cover at least part of the first main extension surface, the same covering will come to define an internal surface of the support. Vice versa, if the covering is arranged on the second main extension surface, the same covering will come to define an external surface of the support. The covering can also be thermally treated in a manner so to be able to act as an element for engaging and fixing portions of the support, as will be better described hereinbelow. The covering can also be employed in order to define a kind of barrier to water and/or to humidity useful for preventing the weakening and the loss of structure of the support, with consequent uncontrolled deformation of the paper material constituting the latter component. The covering can be applied to the paper material (as specified above on the internal and/or external side of the support) in the form of a so-called "coating" or lacquer of thickness generally comprised between 20 and 400 μm, in particular between 30 and 200 μm, still more particularly between 30 and 80 μm. Advantageously, but not exclusively, the covering can comprise a polythene-coating on one or both (internal and/or external side) sides of the paper material defining the support with thickness values that can for example vary between 20 and 400 μm, in particular between 30 and 200 μm, still more particularly between 30 and 80 μm, of covering material (i.e. polythene). The plastic covering material can for example be selected from among the following materials: LDPE, HDPE, PP, PE, polyesters, PVdC. The support can alternatively be at least partly made of single-layer or multilayer thermoplastic material. Preferably, the support is provided with barrier properties against gas. As used herein, such term refers to a film or sheet of material which has an oxygen transmission speed lower than 200 cm$^3$/m$^2$-day-bar, preferably lower than 150 cm$^3$/m$^2$-day-bar, still preferably lower than 100 cm$^3$/m$^2$-day-bar when measured in accordance with ASTM D-3985 at 23° C. and 0% relative humidity. Gas-barrier materials suitable for single-layer thermoplastic containers are for example polyesters, polyamides and the like.

Preferably, the support is made of a multilayer material comprising at least one gas barrier layer and at least one weldable layer in order to allow the welding of the covering film to the surface of the support. The gas barrier polymers that can be employed for the gas barrier layer are PVDC, EVOH, polyamides, polyesters and mixtures thereof. PVDC is any vinylidene chloride copolymer in which a greater quantity of the copolymer comprises vinylidene chloride and a lower quantity of the copolymer comprises one or more unsaturated monomers that can be copolymerized therewith, typically vinyl chloride and alkyl acrylates or methacrylates (e.g. methylacrylate or methacrylate) and mixtures thereof in different proportions. Generally, a barrier layer made of PVDC will contain plasticizing and/or stabilizing agents as known in the art. As used herein, the term EVOH includes ethylene-vinylacetate copolymers, saponified or hydrolyzed, and refers to ethylene/vinyl alcohol copolymers having an ethylene co-monomer content preferably composed of a percentage between about 28 and about 48 mole %, more preferably between about 32 and about 44 mole %, of ethylene, and a saponification level of at least 85%, preferably at least 90%.

The term polyamides is intended to indicate homo- and co- or ter-polymers. This term specifically includes aliphatic polyamides or co-polyamides, for example polyamide 6, polyamide 11, polyamide 12, polyamide 66, polyamide 69, polyamide 610, polyamide 612, copolyamide 6/9, copolyamide 6/10, copolyamide 6/12, copolyamide 6/66, copolyamide 6/69, aromatic and partially aromatic polyamides or copolyamides, such as polyamide 61, polyamide 6I/6T, polyamide MXD6, polyamide MXD6/MXDI, and mixtures thereof.

The term polyesters refers to polymers obtained from the polycondensation reaction of dicarboxylic acids with dihydroxylic alcohols. Suitable dicarboxylic acids are for example terephthalic acid, isophthalic acid, 2,6-naphthalene dicarboxylic acid and the like. Suitable dihydroxylic alcohols are for example ethylene glycol, diethylene glycol, 1,4-butanediol, 1,4-cyclohexanedimethanol and the like. Examples of useful polyesters include poly(ethylene terephthalate) and copolyesters obtained by means of reaction of one or more carboxylic acids with one or more dihydroxylic alcohols.

The thickness of the gas barrier layer will preferably be set in order to supply the material constituting the support with an oxygen transmission speed at 23° C. and 0% relative humidity lower than 50, preferably lower than 10 cm$^3$/m$^2$·d·atm, when measured in accordance with ASTM D-3985.

In general, the weldable layer will be selected from among polyolefins, such as ethylene homo- or co-polymers, propylene homo- or co-polymers, ethylene/vinylacetate copolymers, ionomers and homo- or co-polyesters, e.g. PETG, a polyethylene terephthalate modified with glycol. As used herein, the term "copolymer" indicates a polymer derived from two or more types of monomers and includes terpolymers. The ethylene homo-polymers include high-density polyethylene (HDPE) and low-density polyethylene (LDPE). Ethylene copolymers include ethylene/alpha-olefin copolymers and ethylene/unsaturated ester copolymers. The ethylene/alpha-olefin copolymers generally include ethylene copolymers and one or more co-monomers selected from alpha-olefin having between 3 and 20 carbon atoms, such as 1-butene, 1-pentene, 1-hexene, 1-octene, 4-methyl-1-pentene and the like.

The ethylene/alpha-olefin copolymers generally have a density in the interval between about 0.86 and about 0.94 g/cm$^3$. It is generally intended that the term linear low-density polyethylene (LLDPE) includes that group of ethylene/alpha-olefin copolymers which fall within the density interval between about 0.915 and about 0.94 g/cm$^3$ and in particular between about 0.915 and about 0.925 g/cm$^3$. Sometimes, the linear polyethylene in the density interval between about 0.926 and about 0.94 g/cm$^3$ is indicated as linear medium-density polyethylene (LMDPE). The ethylene/alpha-olefin copolymers with lower density can be indicated as very-low-density polyethylene (VLDPE) and ultra-low-density polyethylene (ULDPE). The ethylene/alpha-olefin copolymers can be obtained with heterogeneous or homogeneous polymerization processes. Another useful ethylene copolymer is a ethylene/unsaturated ester copolymer, which is the copolymer of ethylene and one or more monomers of unsaturated esters. Useful unsaturated esters include vinyl esters of aliphatic carboxylic acids, in which the esters have between 4 and 12 carbon atoms, such as vinylacetate, and acrylic or methacrylic acid alkyl esters, in which the esters have between 4 and 12 carbon atoms. The ionomers are copolymers of an ethylene and an unsaturated monocarboxylic acid having the carboxylic acid neutralized by a metal ion, such as zinc, or preferably sodium. Useful propylene copolymers include propylene/ethylene copolymers, which are propylene and ethylene copolymers having a percentage content by weight with majority propylene and propylene/ethylene/butene ter-polymers, which are copolymers of propylene, ethylene and 1-butene.

Additional layers, such as adhesive layers, for example in order to make the gas barrier layer better adhere to the adjacent layers, can preferably be present in the material constituting the support and are selected on the basis of the specific resins used for the gas barrier layer.

In the case of a multilayer structure, part of this can be foamed. For example, the multilayer material used for forming the support can comprise (from the outermost layer to the layer of contact with the more internal foods) one or more structural layers, typically made of a material such as polystyrene foam, polyester foam or polypropylene foam, or cardboard, or cast sheet for example of polypropylene, polystyrene, poly(vinylchloride), polyester; a gas barrier layer and a weldable layer. An easy-to-open breakable layer can be positioned adjacent to the weldable layer in order to facilitate the opening of the final packaging. Mixtures of polymers with low cohesive resistance which can be used as breakable layer are for example those described in the document WO99/54398. The overall thickness of the support will typically but not exclusively be up to 5.00 mm, preferably it will be comprised between 0.04 and 3.00 mm and more preferably between 0.05 and 1.50 mm, still more preferably between 0.15 and 1.00 mm).

The support can be entirely made of paper material (optionally, covering made of plastic material film) or it can be entirely made of plastic material. In a further embodiment variant, the support is at least partly made of paper material and at least partly of plastic material; in particular, the support is internally made of plastic material and at least partly externally covered in paper material.

In a further embodiment variant, the support can be at least partly made of metallic material, in particular made of aluminum. The support can also be made at least partly of aluminum and at least partly of paper material.

In general, the support can be made of at least one of the following materials: metal, plastic, paper.

The Film

A film can be applied to the supports or trays so as to make a fluid-tight package housing the product. If it is desired to make a vacuum package, the film applied to the support is typically a flexible multilayer material comprising at least one first external weldable layer capable of being welded to the internal surface of the support, optionally a gas barrier layer and a second heat-resistant external layer. The polymers used in said multilayer material must be easily formable since the film must be taut and softened by the contact with the heating plate before being laid on the product and the support. The film must be laid on the product, being adapted to its shape and possibly to the internal shape of the support.

The weldable external layer can comprise any polymer capable of being welded to the internal surface of the support. Polymers suitable for the weldable layer can be ethylene homo- and co-polymers, such as LDPE, ethylene/alpha-olefin copolymers, ethylene/acrylic acid copolymers, ethylene/methacrylic acid ethylene/vinylacetate copolymers or copolymers, ionomers, co-polyesters, e.g. PETG. Preferred materials for the weldable layer are LDPE, ethylene/alpha-olefin copolymers, e.g. LLDPE, ionomers, ethylene/vinylacetate copolymers and mixtures thereof.

Based on the product to be packaged, the film can comprise a gas barrier layer. The gas barrier layer typically comprises oxygen-impermeable resins such as PVDC, EVOH, polyamides and mixtures of EVOH and polyamides. Typically, the thickness of the gas barrier layer is set in a manner so as to provide the film with an oxygen transmission speed at 23° C. and 0% relative humidity lower than 100 $cm^3/m^2 \cdot d \cdot atm$, preferably lower than 50 $cm^3/m^2 \cdot d \cdot atm$, when measured in accordance with ASTM D-3985. Common polymers for the heat-resistant external layer are for example ethylene homo- or co-polymers, ethylene/cyclic olefin copolymers, such as ethylene/norbornene copolymers, propylene homo- or co-polymers, ionomers, polyesters, polyamides. The film can also comprise other layers such as adhesive layers, filling layers and the like in order to supply the necessary thickness to the film and to improve its mechanical properties, such as puncture resistance, abuse resistance, formability and the like. The film is obtained by means of any suitable co-extrusion process, through an extrusion head with flat or circular opening, preferably by means of co-extrusion or by means of hot blowing.

For use in a "skin-pack" or "VSP" packaging process, otherwise termed vacuum packaging process, the film is substantially non-oriented. Typically the film, or only one or more of its layers, is crosslinked in order to improve, for example, the force of the film and/or the heat resistance when the film is brought into contact with the heating plate during the vacuum skin-pack packaging process. The crosslinking can be obtained by means of use of chemical additives or by subjecting the film layers to energy radiation treatment, such as treatment with high-energy electron beam, in order to induce the crosslinking between molecules of the irradiated material. Films suitable for this application have a thickness in the interval between 50 and 200 micrometers, between 70 and 150 micrometers. Films suitable for use as film in a vacuum skin-pack packaging process are for example those sold by Cryovac® with the commercial names TS201®, TH300®, VST™0250, VST™0280.

DETAILED DESCRIPTION

Packaging Apparatus

Reference number 1 overall indicates a packaging apparatus for packaging a product P arranged on a support 4, for example on a flat support or on a tray provided with lateral wall. The apparatus 1 is for example configured for the vacuum packaging of the product in which a thin film of plastic material is arranged on the product and closely adheres at least to an upper edge of the support, to the upper or internal surface of the support not occupied by the product, as well as to the surface of the product thus leaving a minimal quantity of residual air inside the package. The apparatus 1 can also be used for forming controlled atmosphere in a package from which air has been previously removed.

The apparatus 1 comprises a frame 2, a transport group 25 brought by the frame 2 and configured for moving the support 4 along a pre-set operating path from a station 26 for loading preformed supports (e.g. see FIG. 1) or from a station 27 for forming supports (e.g. see FIG. 4) towards a packaging station 5.

The transport group 25 can for example comprise a sliding surface 28, normally horizontal, and a conveyor 3 associated with the sliding surface 28 in order to move the supports 4 along the pre-set advancement path, in particular in the horizontal direction indicated by the arrow A1 shown in FIG. 1. The conveyor 3 is configured for moving a pre-set number of supports 4 each time along the advancement path until they are positioned inside a packaging station 5 where the supports 4 are coupled with respective film portions 6. For example, a control unit 24 can control the conveyor 3 in order to move a pre-set number of supports 4 from a region outside the packaging station 5 to a region inside the packaging station 5 where the supports are situated vertically aligned with respective film portions 6.

The conveyor 3 can, for example, comprise a first transfer device 3*a* (for example the conveyor belt shown in FIGS. 1-4) configured for bringing the supports 4 in proximity to the packaging station and a second transfer device 3*b* (schematically represented in FIGS. 1-4) adapted to pick up one or more of said supports 4 and bring them into the packaging station 5. The second transfer device 3*b* can for example include arms or other devices active on the supports 4 and capable of collecting a pre-set number of such supports 4 from the first transfer device 3*a*, bring them into the packaging station 5 in order to then return towards the first transfer device 3*a* and pick up a successive series of supports 4.

As an alternative, the conveyor 3 can include pushers (e.g., in the form of bars that extend transverse to said direction A1) active on the supports 4 and capable of sequentially pushing pre-set series of supports inside the packaging group 5. For example, the pushers can be moved by chain or belts and can be moved to the interior of the packaging station 5 in order to correctly position a pre-set number of supports, and then be retracted from the packaging station once the supports have reached the correct position inside the same packaging station.

According to a further alternative, the conveyor 3 can include housings (for example in the form of plates provided with cavities shaped for receiving a pre-set number of supports) which are moved along said direction A1 and which are moved inside the packaging station 5 together with the supports: according to the latter alternative, the housings are suitably shaped in order to be housed inside the packaging station during the application of the film to the support.

In accordance with one aspect, the conveyor group 25 can also comprise at least one motor member 29, for example a stepper motor group or a system of actuators, for driving the conveyor 3 and conferring a stepping movement to the supports 4.

It is observed that the products P can be positioned on the or in the support 4 either manually or due to a suitable product loading device. In the case of FIG. 1, the loading of the product onto or into the respective support 4 can occur upstream of the loading station 26, at the loading station 26, or in any position between the loading station 26 and the packaging station 5; otherwise, in the case of FIG. 4 (in-line forming of the support) the positioning of the product P on the support occurs downstream of the forming station 27, in any one position between the forming station 27 and the packaging station 5.

The apparatus 1 also comprises a group 30 for feeding a film, in particular a plastic material film of the above-described type intended to be coupled with the support 4. The film feeding group 30 can for example comprise a feeding roller 31 supported by a respective support structure, for example comprising one or more uprights in turn carried by the frame 2. The film feeding group 30 can be configured for forming a plurality of discrete sheets upstream of the packaging station (see once again the example of FIG. 1): in this case, the feeding group 30 comprises a film cutting unit 32 for the film which, starting from a continuous web, is transversely cut and, optionally, also longitudinally cut, in a manner so as to form film portions 6 or a plurality of discrete sheets 6 of pre-set size that are then sent to the packaging station 5, as will be described hereinbelow in greater detail.

The film cutting unit 32 comprises a cutting device with a blade 33 and an actuator 34. Such actuator 34 can be any one type of electrical, pneumatic or hydraulic actuator. The actuator 34 is preferably fixed to the frame 2 and is connected to the cutting device so as to push and pull the blade 33 in a direction transverse to the unrolled film portion, as indicated by the double arrow A2 of FIG. 1.

Figure 2:
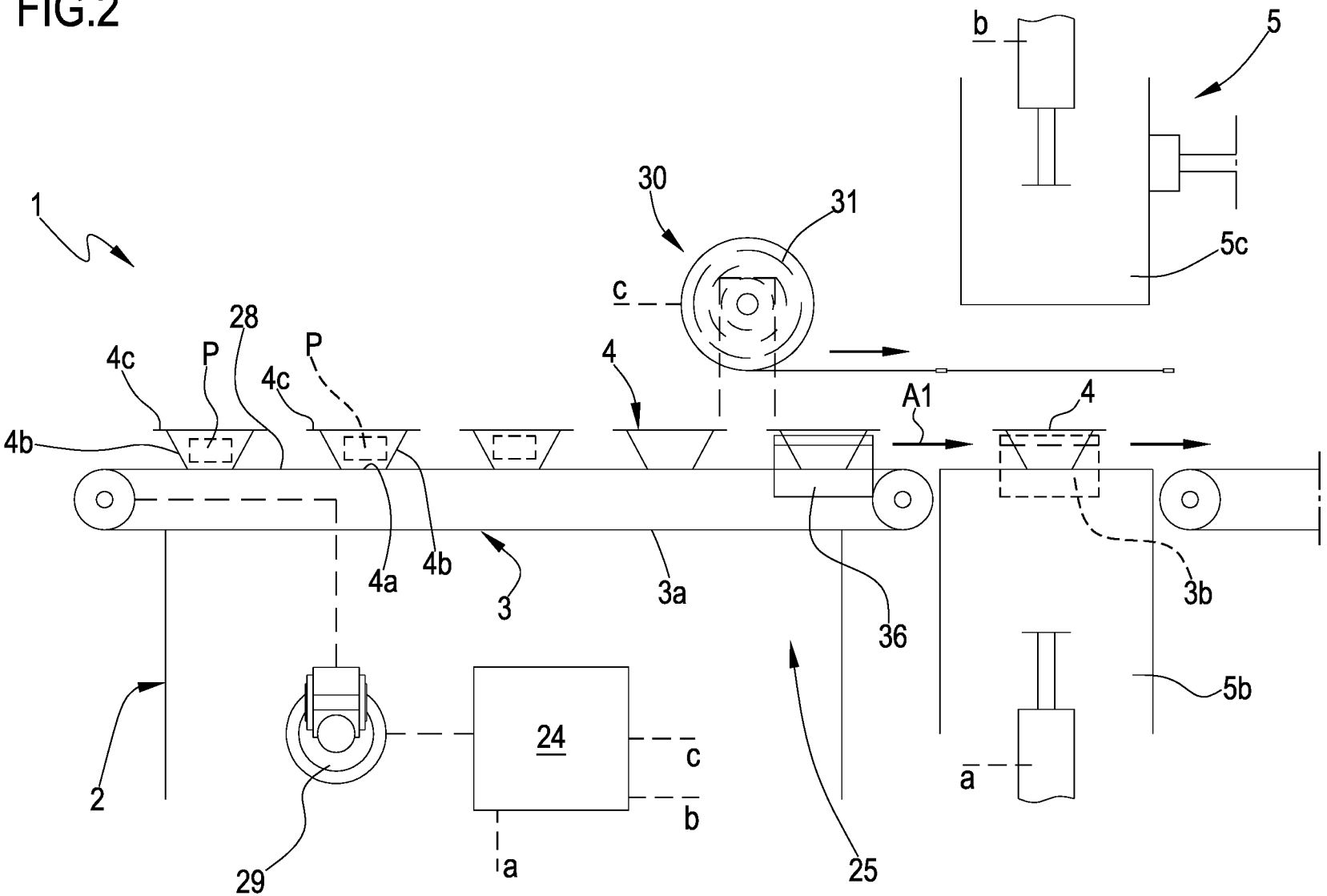
FIGS. 2 to 4 are schematic views of embodiment variants of a packaging apparatus in accordance with the present invention in which a film is supplied—starting from a reel—to a packaging station of the same apparatus where the film is heat sealed on the tray and cut into separate sheets.
Figure 3:
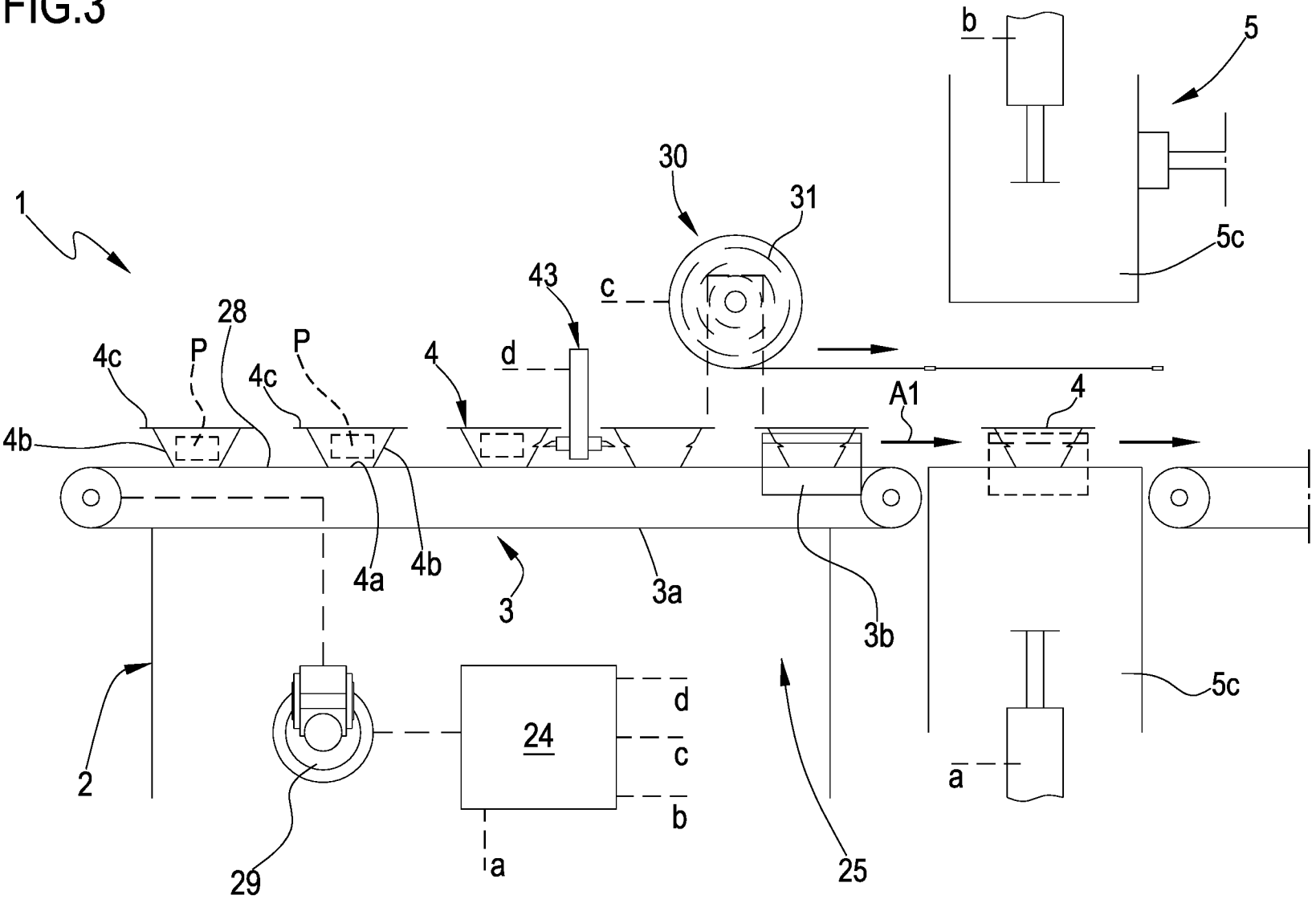
Figure 4:
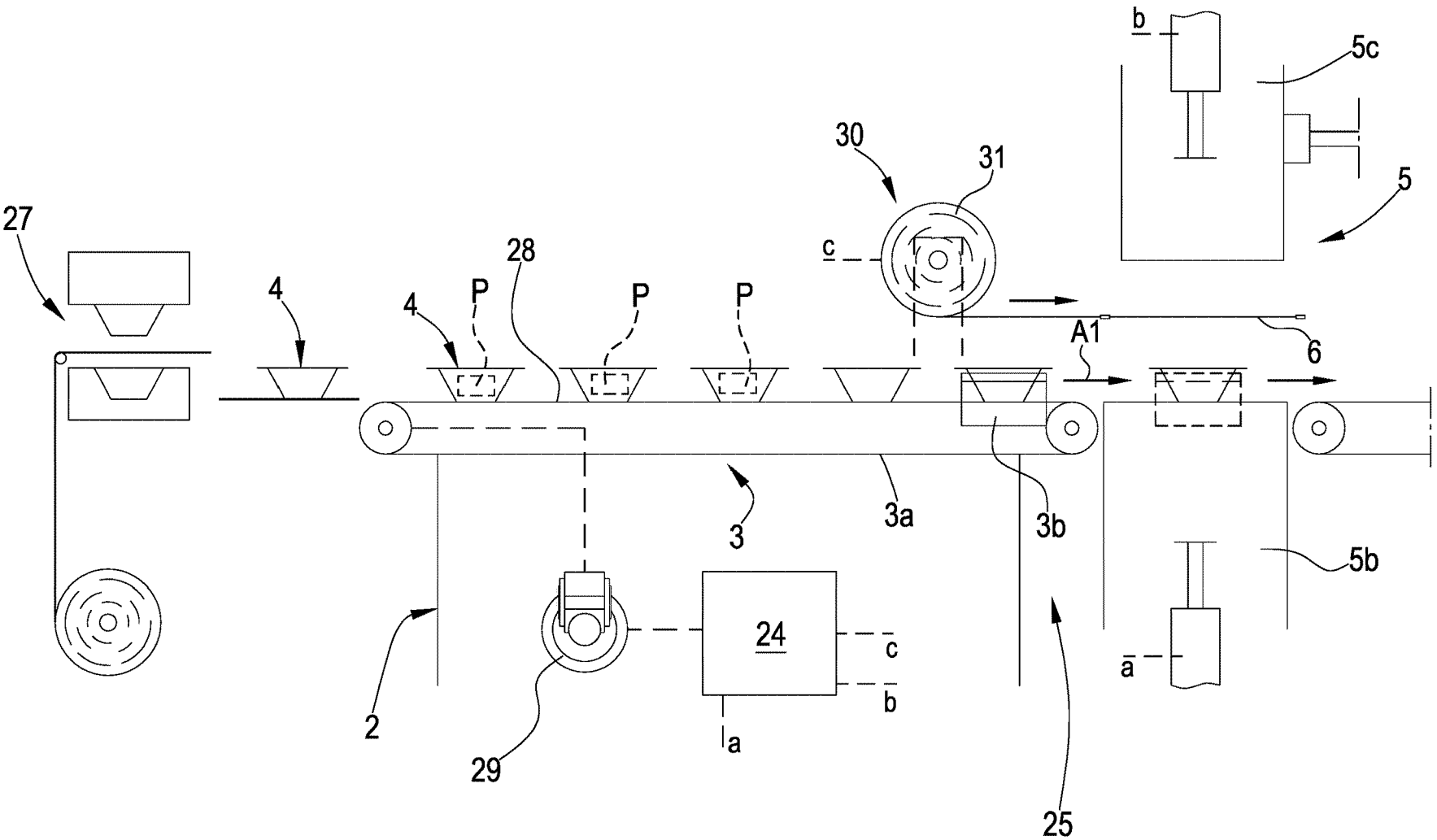

Alternatively, the feeding group 30 can be configured for unwinding the plastic film from the feeding roller 31, suitably guiding it and sending it in the form of continuous web to the packaging station 5 (this alternative is for example shown in FIGS. 2-4). In this case, the cutting of the film 6—if necessary—can occur after the film 6 has been fixed to the support 4 and/or after the step of removal or modification of the gas inside the support 4 has been completed.

The packaging station 5 is configured for fixing a film portion 6 to said supports 4 and comprises a lower tool 5*b* and an upper tool 5*c*. The lower tool 5*c* has internal walls 35 defining a pre-set number of positioning seats 5*a* of the supports 4. In one embodiment, the lower tool 5*b* is provided with multiple positioning seats 5*a*: each seat 5*a* is arranged for housing a corresponding support 4; in this case the upper tool 5*c* is provided with one or more retention structures 36 for retaining the film 6 above the support or supports 4 present in the respective positioning seats 5*a*.

For example, in the embodiment pursuant to FIGS. 5*a* to 5*k*, a lower tool 5*b* is shown that is provided with a seat 5*a* for receiving a respective support (illustrated in a non-limiting manner in the embodiments of FIGS. 5*a*-5*j* are trays 4 with lateral wall, while in FIG. 5*k* the embodiment is represented in which the support has flat shape) and an upper tool 5*c* comprises a retention structure 36, for example plate-shaped, intended to position a film portion 6 above and aligned with the support 4 present in said seat 5*a*.

Figure 5A:
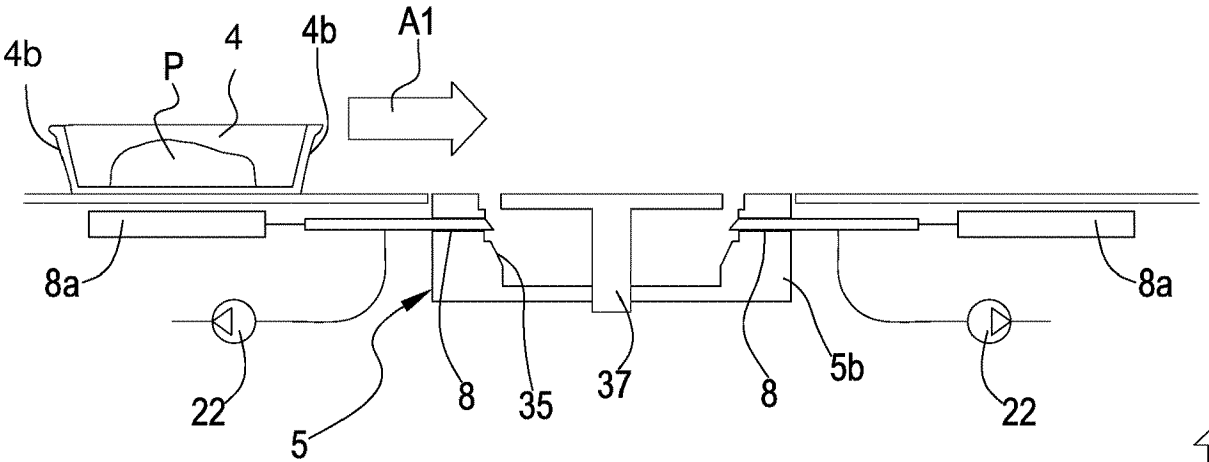
Figure 5B:
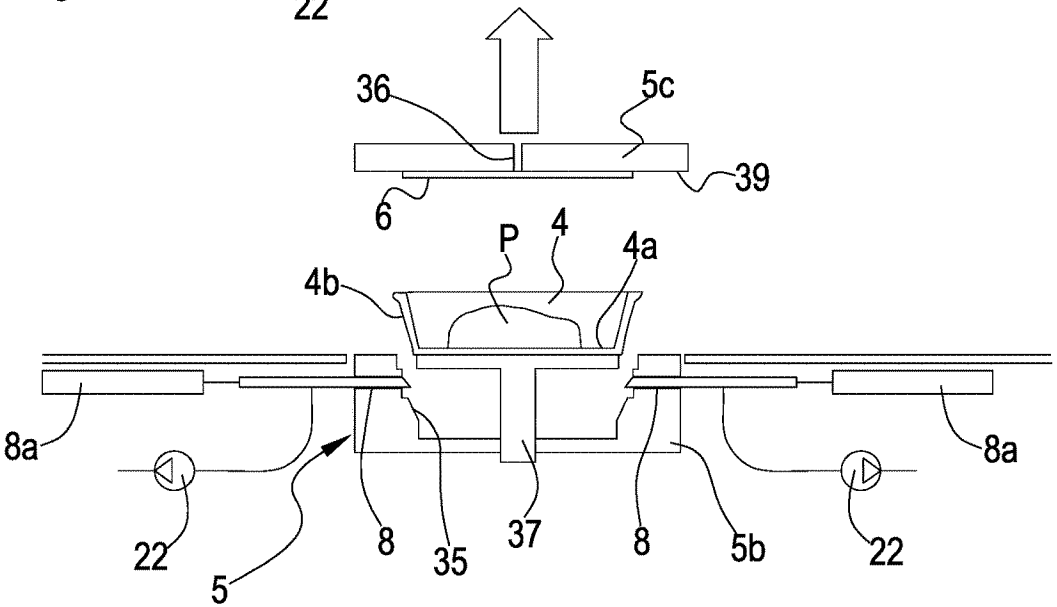
Figure 5E:
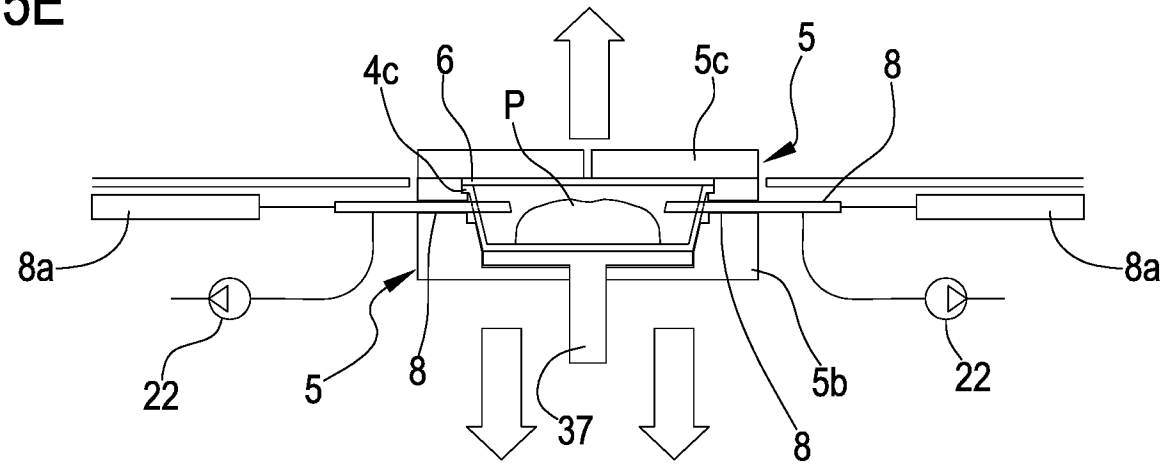
Figure 5F:
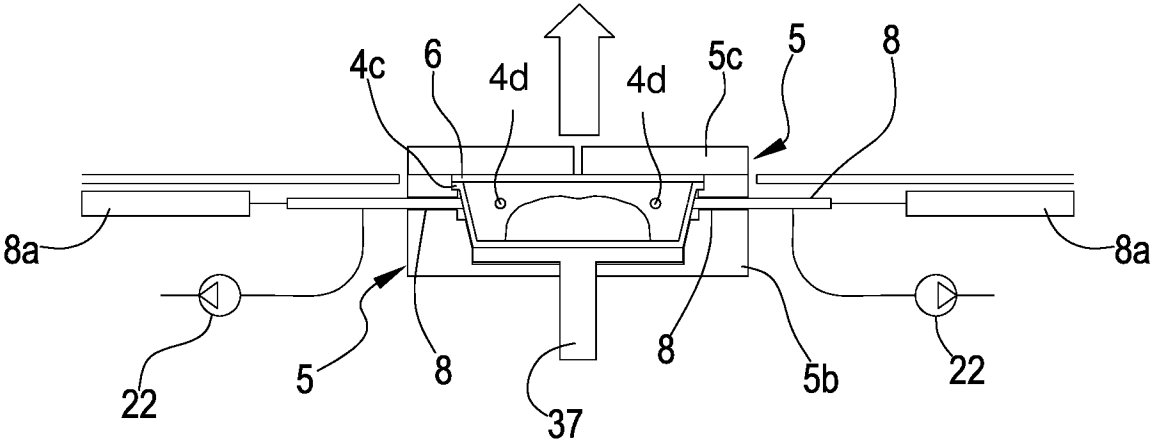
Figure 5G:
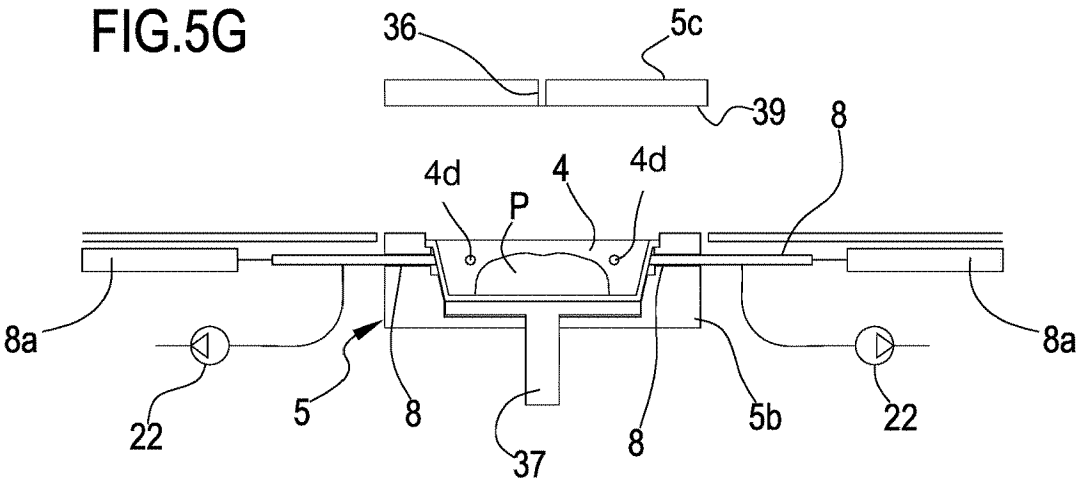
Figure 5H:
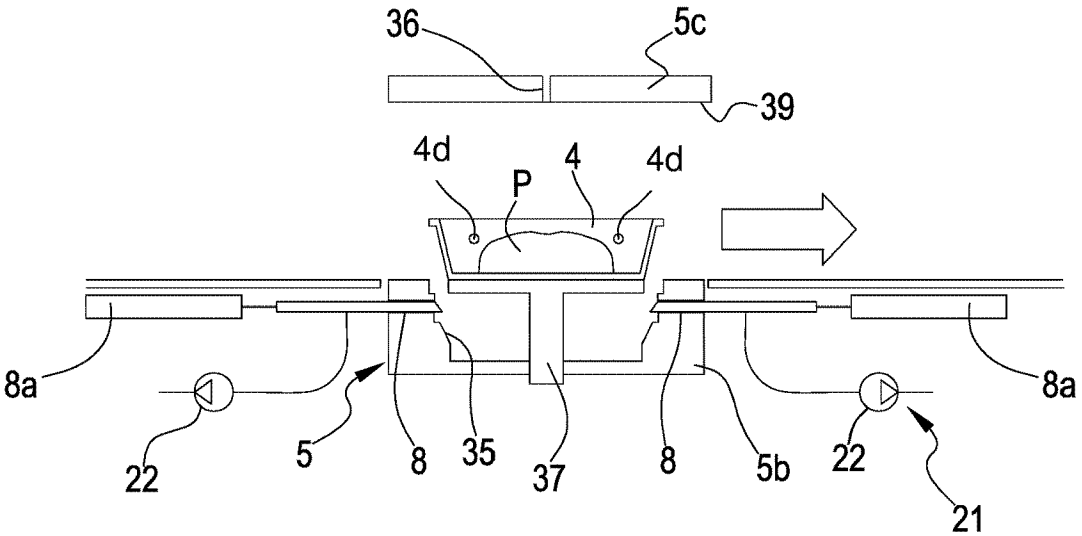
Figure 5J:
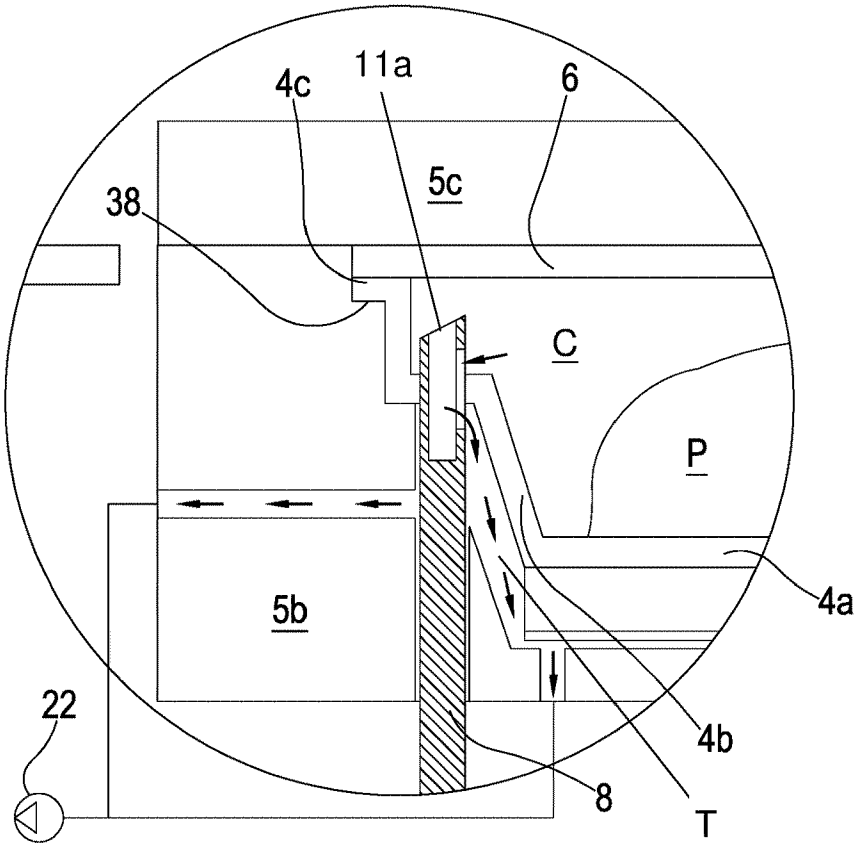
Figure 5I:
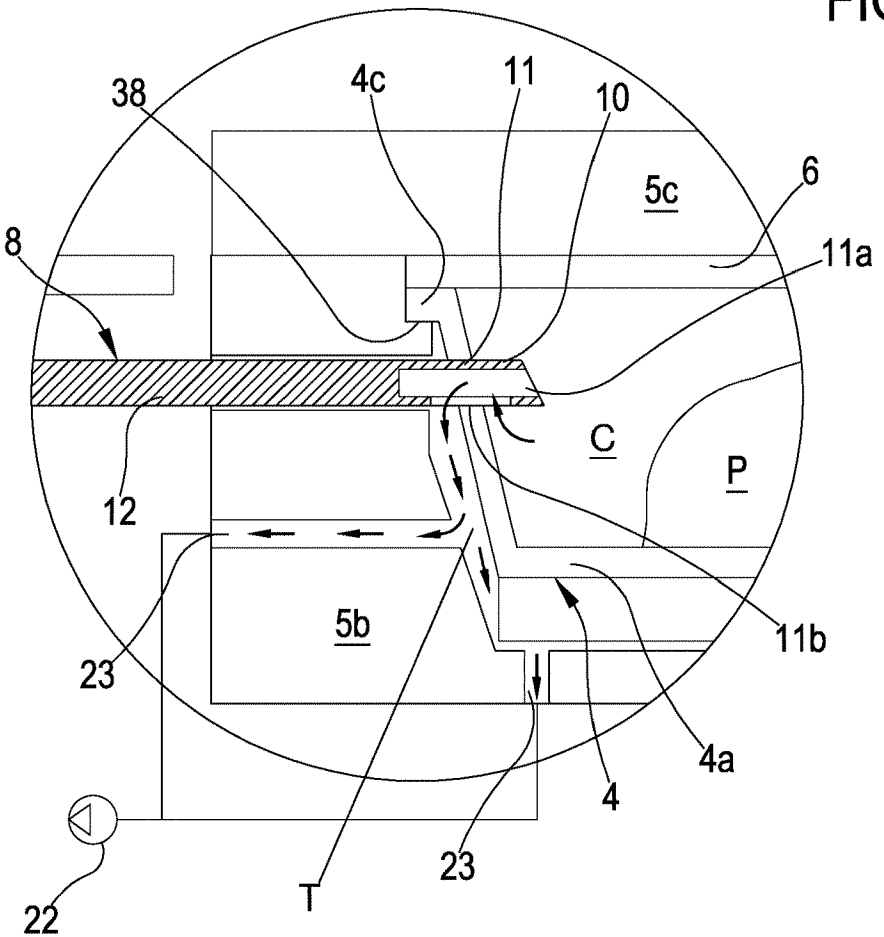
Figure 5K:
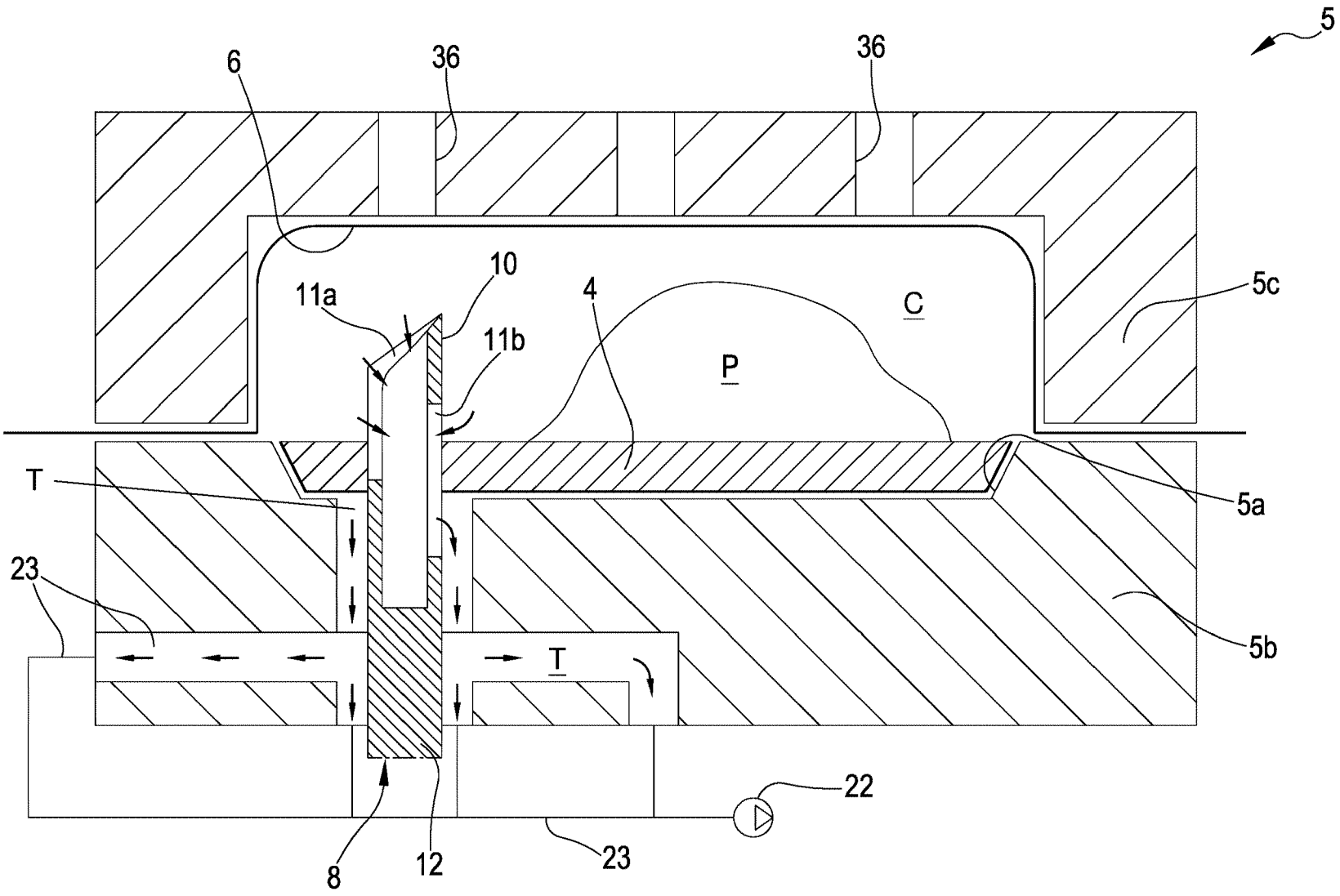
FIG. 5*k* instead shows a packaging apparatus in accordance with the present invention, schematized exemplifyingly arranged for vacuum packaging a product on a flat support.
Figure 7:
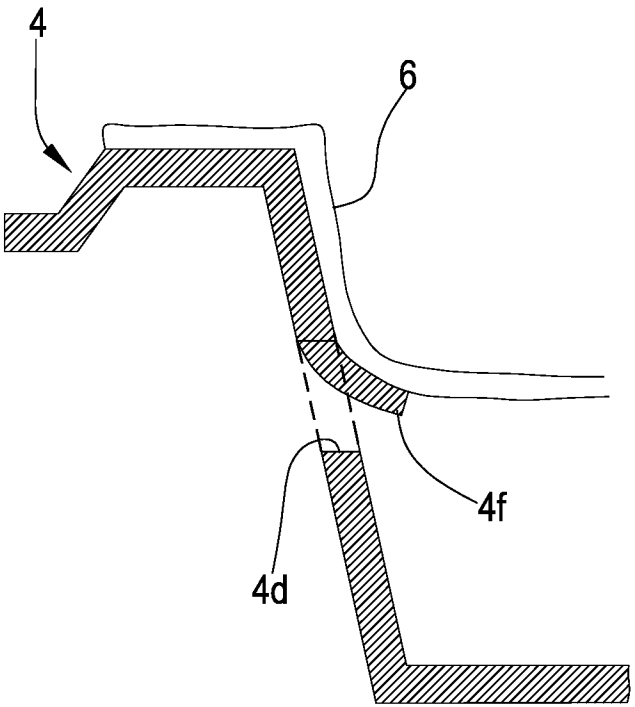
FIGS. 6 to 10 are different representations of a support.
Figure 6:
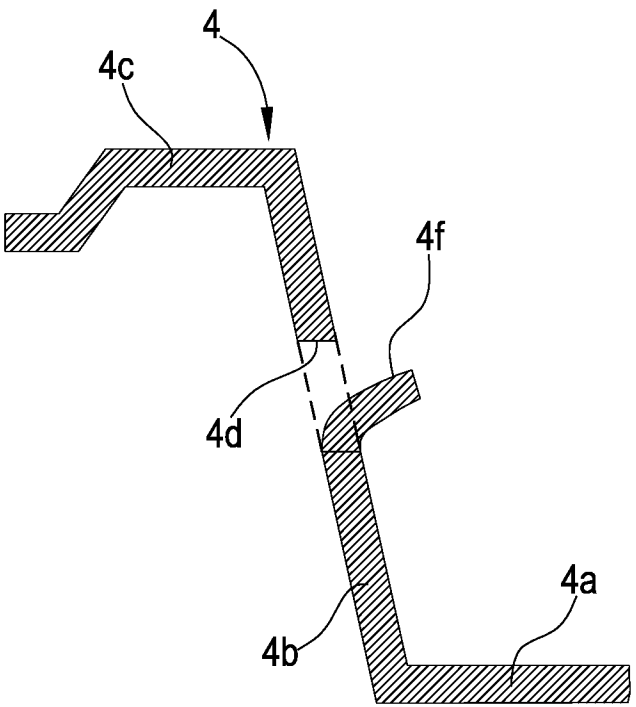
Figure 9B:
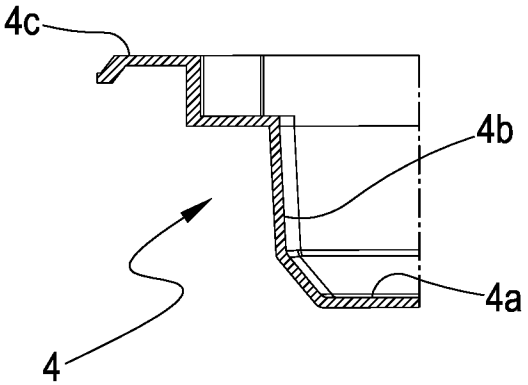
Figure 9A:
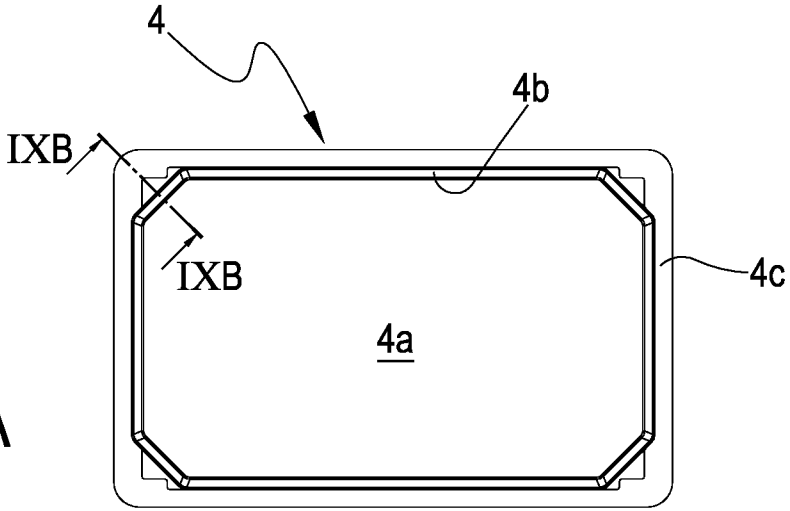
Figure 8:
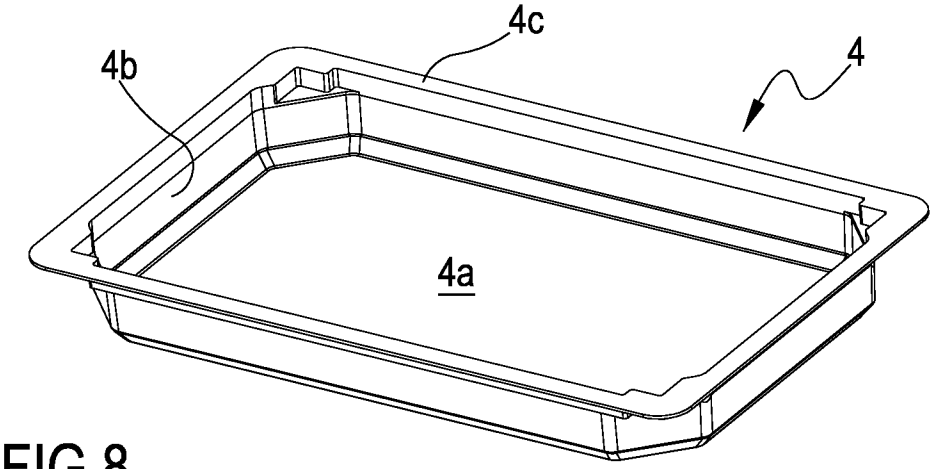

In the case of FIGS. 5*a*-5*j*, the support 4 is a tray having a base 4*a* abutting against a movable plate 37 present in each positioning seat 5*a* of the lower tool 5*b* and a lateral wall 4*b* emerging from base 4*a*: the tray 4 is received in the positioning seat 5*a* so that an annular flange 4*c* of the tray 4 emerging from an upper edge of the lateral wall 4*b* can abut above an end surface 38 of the wall defining said seat 5. In the case of FIG. 5*k*, the flat support 4 is positioned in a positioning seat 5*a* suitably shaped in the lower tool 5*b*. As shown in the figures, the upper and lower tools cooperate in order to define a housing chamber T: in a first operating condition of the packaging station 5—shown in FIGS. 1-4 and 5*a*, 5*b*—the upper and lower tools are spaced from each other and the housing chamber T is opened, enabling the movement of successive film portions inside the housing chamber. In a second operating condition of the packaging station—shown in FIGS. 5*c*-5*k*—the housing chamber T is hermetically closed with respect to an atmosphere outside the apparatus 1. It is observed that by hermetically closed it is intended that the housing chamber cannot freely communicate with the environment outside the chamber itself and that therefore gas can be supplied or extracted from the packaging chamber T only by means of feeding or suctioning channels 23 under the control of the apparatus 1. The retention structure 36 has an active surface 39 (for example flat as in the embodiments or dome-shaped) intended for contact with the film portion 6 placed above the lower tool 5*c*. The upper tool is provided with a heating device (not illustrated since per se known) configured for heating the active surface 39 of the retention structure 36 in a manner so as to confer the desired deformability characteristics to the film 6: in accordance with the cases, a heating device can be provided that is configured for heating the entire active surface of the retention structure or only part thereof (for example a central portion and/or a perimeter portion). The retention structure 36 also provides for a retention system of mechanical type (for example using grippers active on the perimeter edges of the film portion) or of vacuum type comprising a plurality of openings distributed on the active surface that are part of a suctioning system controlled by the control unit 24 so as to generate a suction effect and retain the film portion against the active surface at least during one part of the packaging process.

The transfer of the film within the housing chamber occurs by means of movement of the film in continuous film form: for example, if the film is cut after the packaging, such film can be driven by systems operating downstream of the packaging station. Alternatively, film driving systems can be provided that are active on the longitudinal edges thereof: chains are commonly used with active grippers on the edges of the film.

If, however, the film is cut into discrete sheets upstream of the packaging station 5, the apparatus 1 can comprise a transfer device 40 (see FIG. 1) configured for picking up the sheets cut by the cutting unit 32 and positioning the film sheets inside the packaging station 5 and above the respective support 4. The transfer device 40 can for example comprise a support structure 41 having a flat or slightly convex holding surface adapted to receive the at least one or more sheets of film from the cutting unit 32: FIG. 1 shows that the blade 33 has intercepted the continuous film and a film sheet 6 is positioned at the holding surface. The support structure 41 can hold the cut film sheet by using one or more of the following systems:

- a suctioning system connected to one or more channels present in the support structure and communicating with suction openings situated on the holding surface,
- mechanical supports, such as grippers or the like,
- adhesive systems, for example adhesive portions associated with the holding surface,
- electrical systems, for example the holding surface can be charged with a polarity different from that typical of the plastic sheet.

The transfer device 40 also comprises a mechanism 42, for example carried by the frame 2, active on the support structure 41 and configured for moving the support structure with respect to the packaging station between a first position, in which the support structure 41 is positioned at the cutting unit 32, for example immediately downstream of the blade 33, and at least one second position, in which the support structure 41 is positioned inside the packaging station 5. In the embodiments illustrated in the enclosed figures, the mechanism comprises an active transfer actuator on the support structure in order to move such structure between said first and second position: for example, the transfer actuator can move the support structure along a direction parallel to said horizontal direction A1 as indicated by the double arrow A3 in FIG. 1. Also the transfer actuator can be an electrical, pneumatic or hydraulic actuator.

As an alternative (not illustrated), instead of moving the support structure, the upper tool can be made movable with respect to the frame 2 and be configured for collecting the cut film sheets at the cutting unit. In this case the transfer device 4 includes a mechanism, for example carried by the frame, configured for moving the upper tool between a first position, in which the upper tool is positioned at the support structure in order to pick up one or more film sheets from the support structure, and at least one second position, in which the upper tool is aligned with the lower tool and configured for positioning at least one film sheet above the respective support 4.

The apparatus 1 also comprises a suctioning system or vacuum device 21 connected to the housing chamber T and configured for the removal of gas from inside said chamber. The suctioning system 21 comprises at least one vacuum pump 22 and at least one suctioning channel 23 which connects the interior of said chamber T to the pump 22; the control unit 24 controls the pump 22 in order to draw gas from said housing chamber T, at least when the packaging station 5 is in said second operating condition, i.e. with said housing chamber T hermetically closed.

The apparatus 1 can also comprise a controlled atmosphere generation device connected to the housing chamber and configured for injecting a gas current in said chamber; the controlled atmosphere generation device comprises at least one injection pump and/or an injection valve which acts on at least one injection tube configured for placing the interior of said housing chamber in communication with a gas source (non shown) which can, alternatively, be situated at a distance from the apparatus 1; the control unit 24 can be configured for controlling the opening and the closing of the injection valve (or the activation of the injection pump) and injecting said gas current at least when the packaging station is in said second operating condition, i.e. with said housing chamber hermetically closed.

The control unit 24 can also be configured for controlling the composition of the modified atmosphere generated inside the chamber T. For example, the control unit 24 can regulate the composition of the gas flow injected into the housing chamber. The composition of the gas injected into the housing chamber for generating a modified atmosphere can vary in accordance with the nature of the product P. In general, modified atmosphere mixtures include a volumetric quantity of one or more of $N_2$, $O_2$ and $CO_2$ which is different from the quantity of these same gases in 20° C. atmosphere and at sea level (1 atmosphere pressure).

In accordance with the invention, the apparatus 1 finally comprises at least one penetrating tool 8 associated with the packaging station 5. As described above, the packaging station 5 is configured for:

- receiving at least one support 4 at the positioning seat 5*a*, the support 4 having at least one base wall, and optionally at least one lateral wall emerging from base wall,
- receiving at least one portion of a film 6 above said at least one support so that, between said support and said film portion, a reception volume is defined for the product P,
- sealingly constraining the film portion 6 to said support 4.

The penetrating tool 8 is arranged at least partly inside the packaging station and is suitable to operate at the reception volume. The penetrating tool 8 is movable relative to the positioning seat 5*a* by means of an actuator 8*a*—for example an electrical, hydraulic or pneumatic actuator—at least between a receded position and an advanced position. In the receded position, the penetrating tool 8 is arranged outside the reception volume and is spaced or at most in contact with the base wall or with the lateral wall of the support 4. The penetrating tool 8 is also configured to be arranged in the advanced position in which a part of the tool 8 crosses the base wall or the lateral wall of a support 4 arranged in said positioning seat 5*a*, accessing the reception volume for the product P. In the enclosed FIGS. 5*a*-5*j*, a penetrating tool 8 has been illustrated, adapted to cross through a lateral wall 4*b* or a base wall 4*a* of a tray-shaped support 4. Nevertheless, it is possible to use a support 4 comprising a flat element (see FIG. 5*k*) essentially having a base wall.

As is visible for example in FIGS. 11A-14, the penetrating tool 8 has at least one first through opening 11*a* and at least one second through opening 11*b* distinct and separate from each other. With the term through opening it is intended an opening which places the interior volume of the penetrating tool 8 in fluid communication with a volume outside the tool 8, for example with the volume of the housing chamber T. In particular, when the penetrating tool 8 is in the advanced position, the position of the first through opening and of the second through opening with respect to the wall of the support traversed by the same penetrating tool is as follows:

- the first through opening 11*a* is arranged at least partly in the reception volume for the product P, beyond said base wall or beyond said lateral wall of the support (with 'beyond' it is intended on the other side of the wall penetrated by the tool with reference to the direction and sense of the tool entering the reception volume for the product),
- the second through opening 11*b* is arranged astride said base wall or said lateral wall of the support, i.e. it extends partly inside and partly outside the reception volume for the product such that the wall traversed by the tool is placed at an intermediate zone of the opening.

Figure 12A:
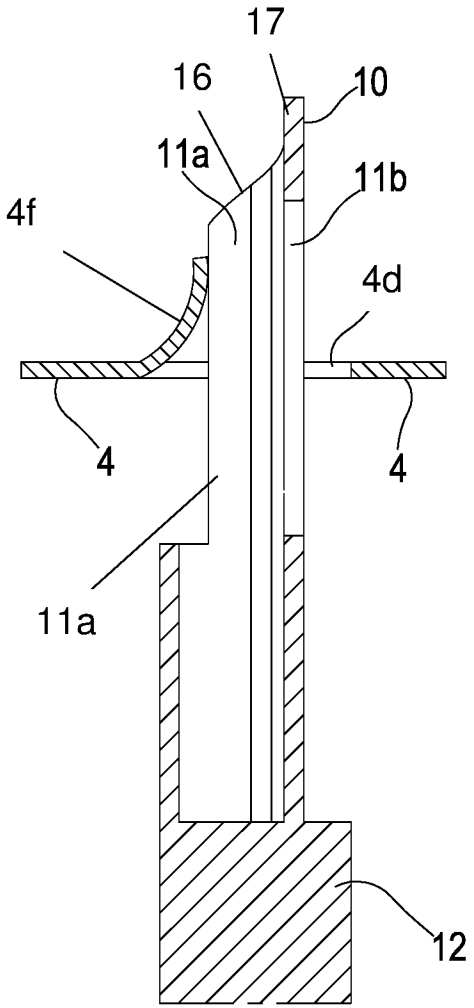
FIG. 12A is a schematic view in section of the penetrating tool, in accordance with FIGS. 11A-11D, arranged in an advanced position in which it cooperates with a base wall or lateral wall of a support.
Figure 12:
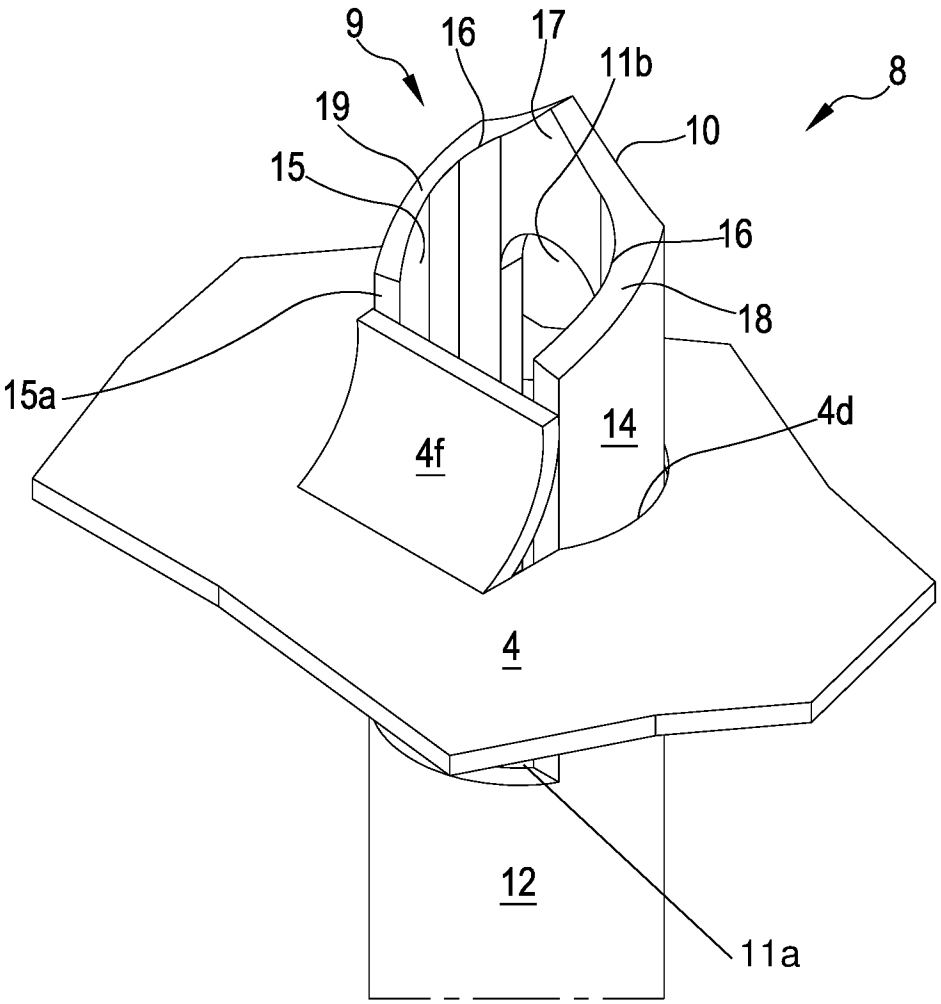
FIG. 12 is a schematic representation of the penetrating tool, in accordance with FIGS. 11A-11D, arranged in an advanced position in which it cooperates with a base wall or lateral wall of a support.
Figure 14A:
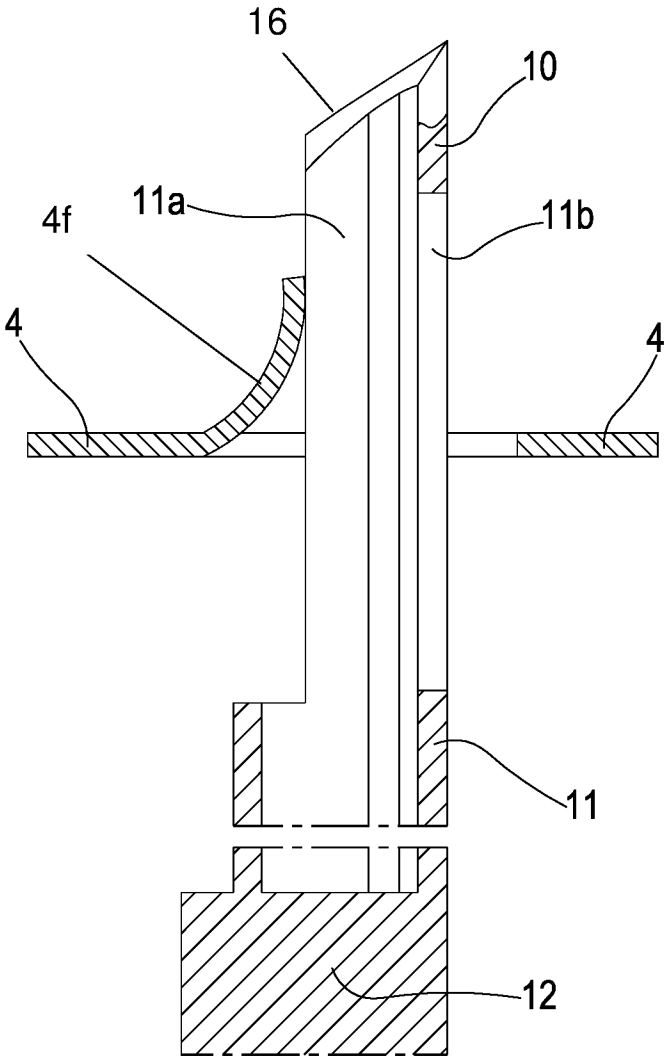
FIG. 14A is a schematic view in section of the penetrating tool, in accordance with FIGS. 13A-13D, arranged in an advanced position in which it cooperates with a base wall or lateral wall of a support.
Figure 14:
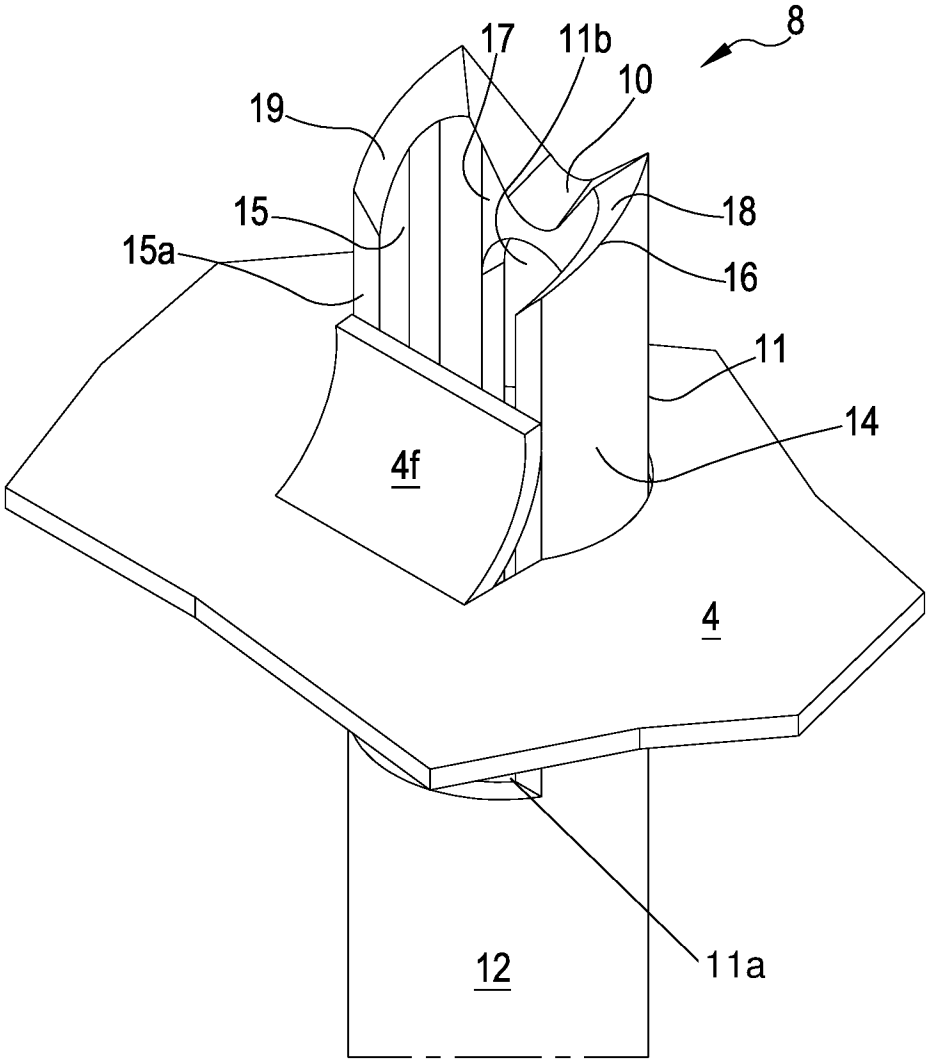
FIG. 14 is a schematic representation of the penetrating tool, in accordance with FIGS. 13A-13D, arranged in an advanced position in which it cooperates with a base wall or lateral wall of a support.
Figure 15:
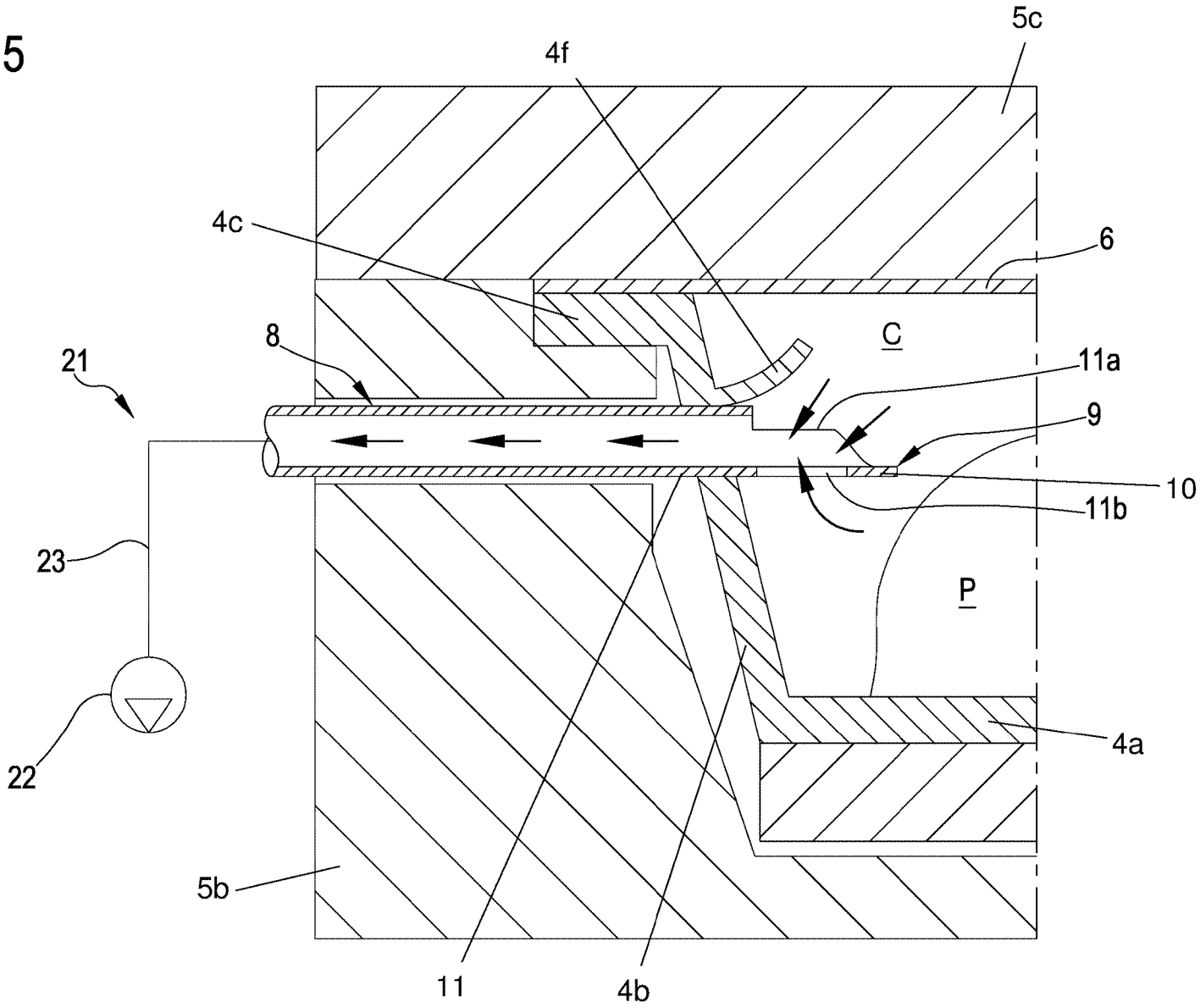
FIG. 15 is a schematic view of a further embodiment variant of a packaging apparatus in accordance with the present invention.

In FIGS. 12, 12A and 14, a configuration is schematized of the penetrating tool 8 arranged in the advanced position in which the openings 11*a*, 11*b* are arranged astride a wall (base wall or lateral wall) of the support 4.

In particular, as is visible for example in FIG. 12A, the second through opening 11*b*—in the advanced position of the penetrating tool 8—partly extends into the reception volume, beyond said base wall or beyond said lateral wall, and partly outside said reception volume.

As will be better described hereinbelow, the penetrating tool 8 can be connected to a suctioning system 21 which allows, by means of said openings 11*a* and 11*b*, air suction from a housing chamber C for the product defined by the cooperation of the support 4 with the film portion 6. Alternatively, the penetrating tool 8 can be connected to a gas injection system adapted to supply a pre-set quantity of a gas to the housing chamber C for the product P, if after having removed ambient air it is desired to create a package in controlled atmosphere.

In detail, the penetrating tool 8 comprises a distal portion 9 which—in the advanced position of the penetrating tool 8—is suitable to be arranged at least partly in the reception volume: the first and the second through opening 11*a*, 11*b* are defined at said distal portion 9. The distal portion 9 has an elongated shape and extends along a main extension direction; such distal portion 9 comprises:

- a front portion 10,
- a rear portion 12,
- an intermediate portion 11 interposed between the front portion and the rear portions 10, 12.

At least the front portion 10 and the intermediate portion 11 are joined as a single piece to define a single body; advantageously, the entire distal portion 9 is made as a single piece.

When the penetrating tool 8 is in advanced position (condition schematized in FIGS. 12, 12A and 14)—the front portion 10 is arranged in the reception volume while the intermediate portion 11 is arranged astride the base wall or lateral wall of the support 4. In particular, the intermediate portion 11—in the advanced position of the penetrating tool 8—is partly arranged in the reception volume, beyond the base wall or beyond the lateral wall, and partly outside said volume. In particular as illustrated in FIG. 12A, the intermediate portion 11 has a pre-set longitudinal extension defined along the main extension direction of the distal portion 9; in the advanced position of the penetrating tool 8, the base wall or lateral wall of the support 4 is situated at a central zone or centerline of the intermediate portion 11.

Advantageously, but not exclusively, the first through opening may extended over the entire extension of the front portion 10 and of the intermediate portion 11. In fact, the first through opening 11*a* is delimited by a closed continuous edge comprising:

- a first section defining one end, optionally sharp/cutting, with a single tip or multiple tips, of the front portion 10,
- a second and a third section, mutually parallel and emerging from ends of the first section,
- a fourth section transverse to the first and to the second section which connects ends of the second and third section axially opposed to the first section.

Figure 11B:
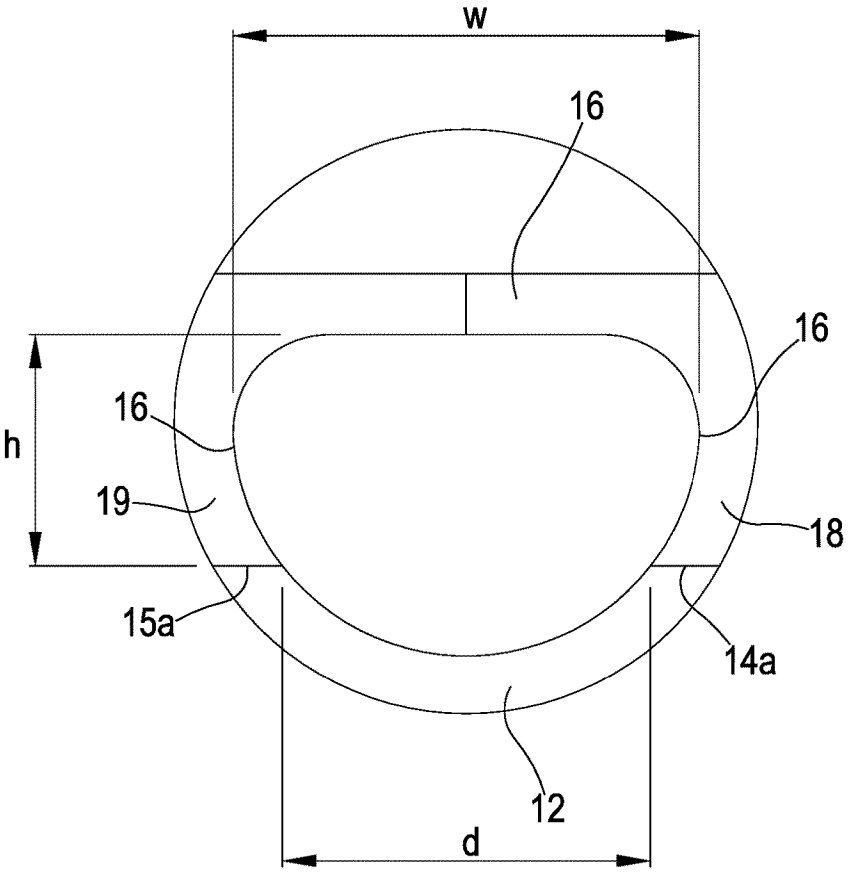
FIGS. 11A to 11D are schematic representations of a first embodiment of a penetrating tool of the packaging apparatus in accordance with the present invention.
Figure 11A:
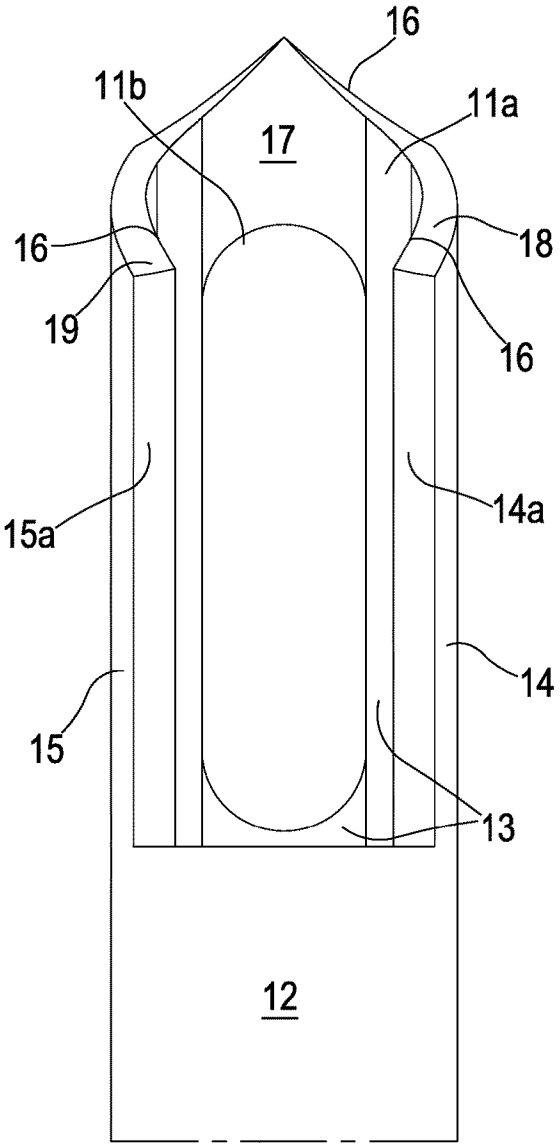
Figure 11D:
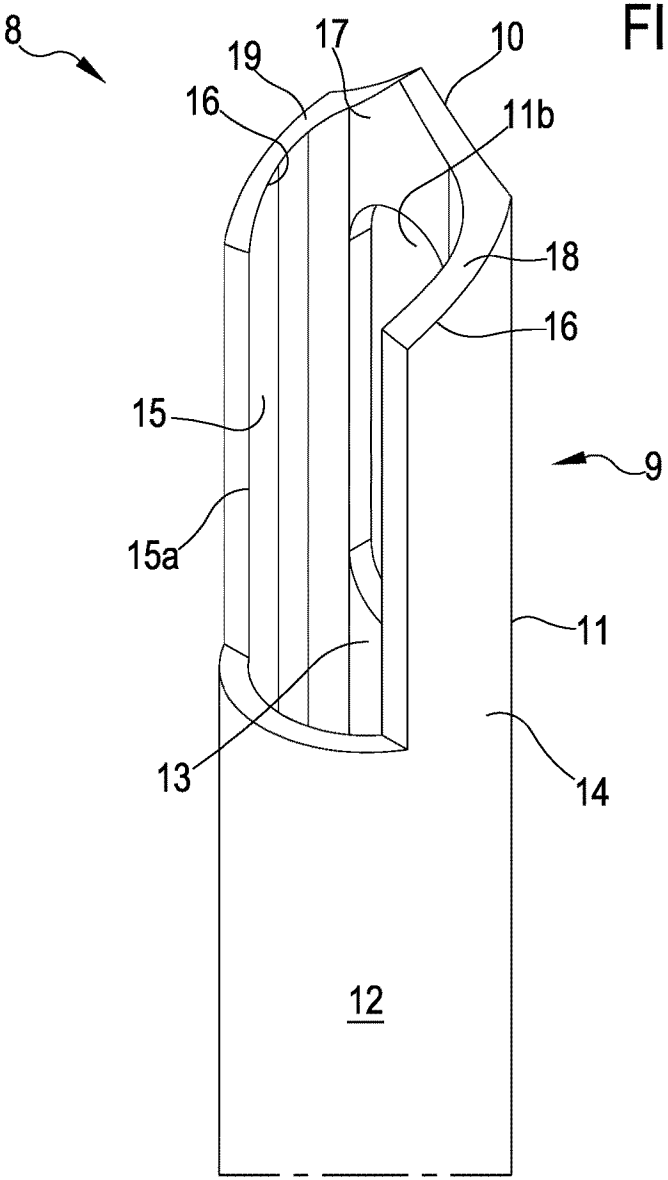
Figure 11C:
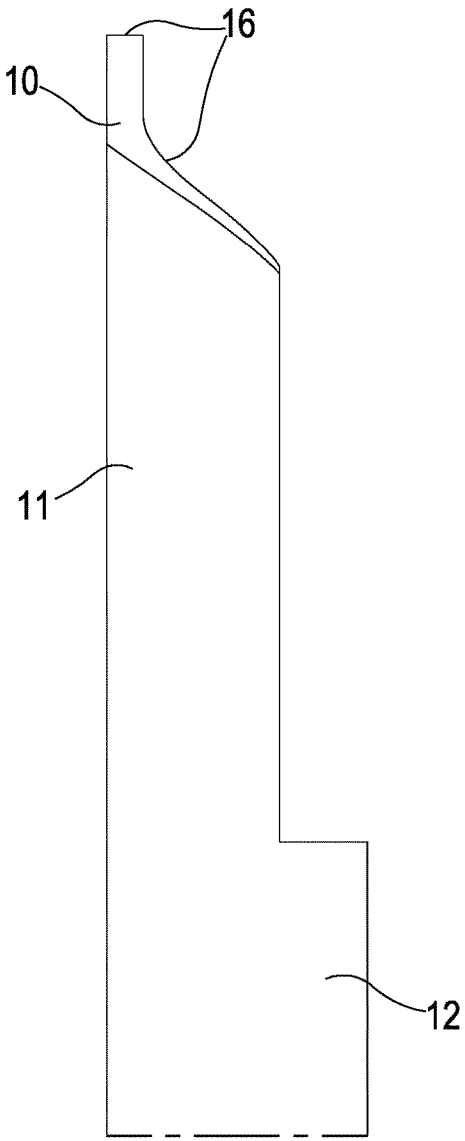
Figure 13B:
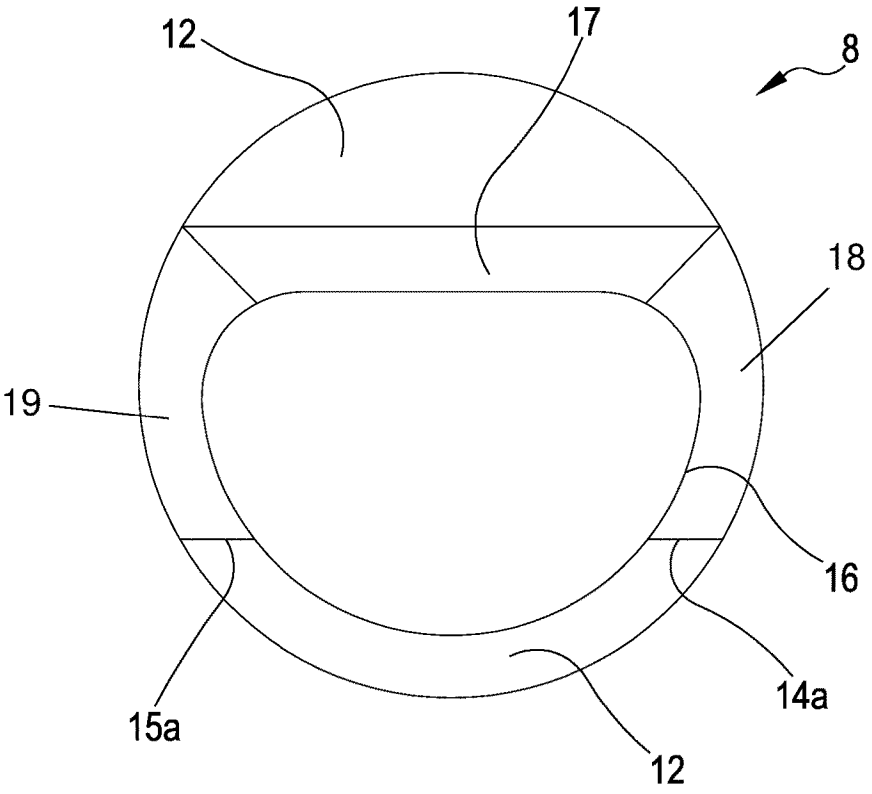
FIGS. 13A to 13D are schematic representations of a second embodiment of a penetrating tool of the packaging apparatus in accordance with the present invention.
Figure 13A:
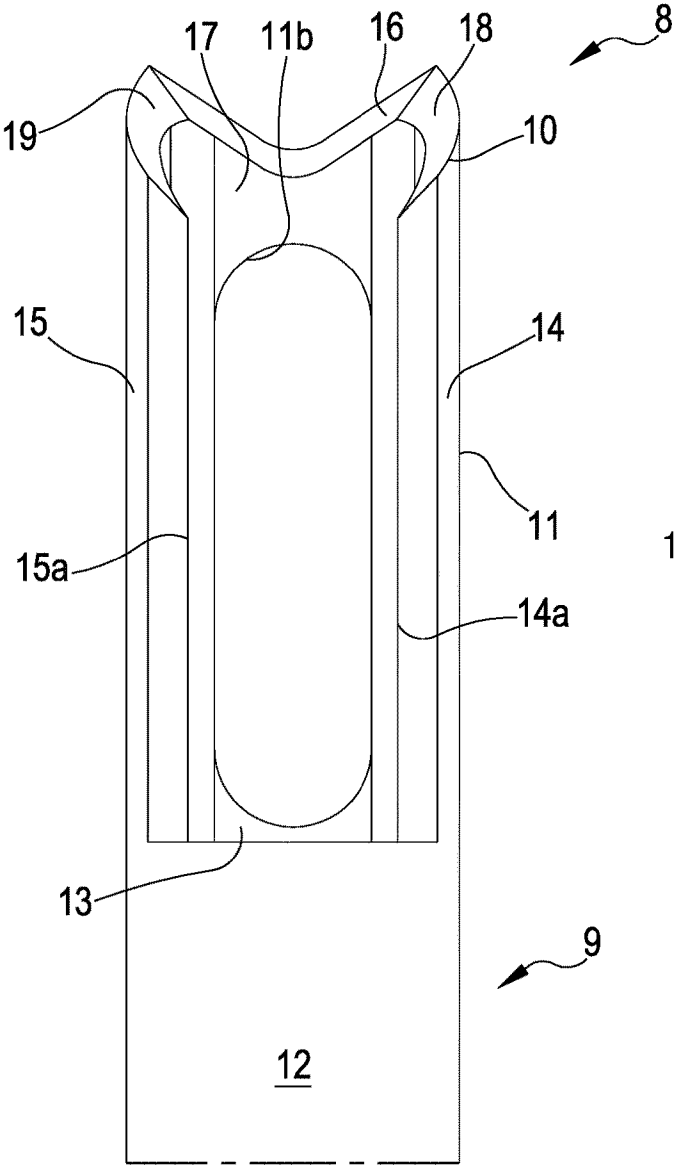
Figure 13D:
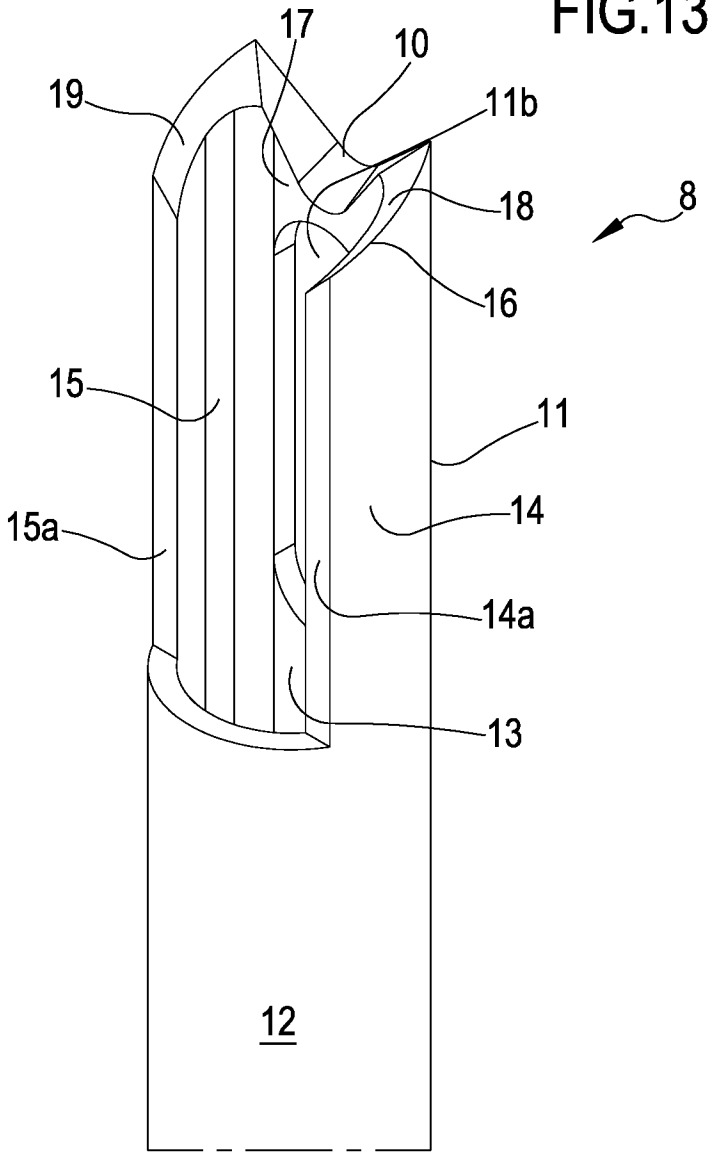
Figure 13C:
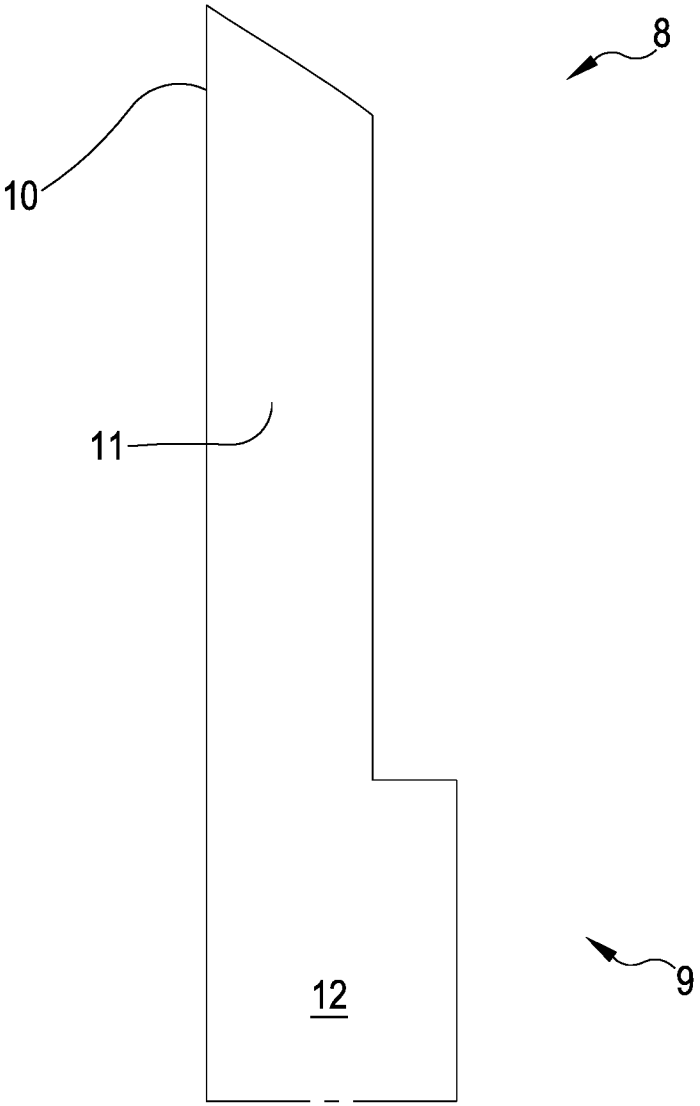

Said sections confer to the closed continuous edge a shape that is non-planar and extended along the longitudinal extension of the penetrating tool 8 (e.g. see FIGS. 11D and 13D).

In more detail, the first through opening 11*a* is defined by a single opening perimetrically delimited by the closed continuous edge.

The second through opening 11*b* instead extends over the entire longitudinal extension of the intermediate portion 11 and along at least part of the entire longitudinal extension of the front portion 10. Also the second through opening 11*b* is defined by a single opening perimetrically delimited by a single closed continuous edge, for example having elliptical elongated shape extending parallel to the main extension direction of the distal portion 9. As for example is visible from FIG. 12A, the first and the second through opening 11*a*, 11*b* are optionally arranged on mutually opposed sides of the penetrating tool 8.

Entering into greater detail in terms of geometry of the distal portion 9, the intermediate portion 11 has—according to a section defined at the first through opening 11*a* and transverse to the main extension direction of the distal portion 9—an open profile, optionally shaped substantially C-shaped or U-shaped.

In particular, the intermediate portion 11 comprises (e.g. see FIGS. 11A and 13A):

- a base 13, in particular flat,
- a first and a second lateral wall 14, 15 emerging from the base 13 starting from opposite perimeter edges of the latter; said first and second lateral walls 14, 15 being connected to each other exclusively by means of said base 13.

The first and the second lateral wall 14, 15 have—on the opposite side with respect to the base 13—respective free edges 14*a*, 15*a* at least partly delimiting the first through opening 11*a*.

As is visible from FIGS. 11B and 13B, the first lateral wall and the second lateral wall emerge from said base 13 and extend from the latter for a same height h.

In a preferred but non-limiting embodiment of the invention, the base 13 of the intermediate portion 11 is flat, and the free edges of the first and second lateral wall 14, 15 are defined on a single plane parallel to the base 13. In particular, the free edges of the first and second lateral walls 14, 15 extend along respective directions parallel to each other, optionally parallel to the main extension direction of the distal portion 9, to define said second and third section of the closed continuous edge of the first through opening 11*a*.

In more detail and as is visible in the enclosed figures, the first lateral wall 14 of the intermediate portion 11 has—according to a section transverse to the main extension direction of the distal portion 9—an arched profile. The second lateral wall 15 of the intermediate portion 11 has—according to a section transverse to the main extension direction of the distal portion 9—an arched profile. The concavities defined by the respective first and second lateral wall 14, 15 are facing each other. With regard to the base 13, the latter—in a preferred but non-limiting embodiment of the invention—is extended along a plane and has a substantially rectangular shape. The second through opening 11*b* is defined on the base 13 and extends along the entire longitudinal extension of the latter.

In one embodiment of the invention, the distal portion 9 comprises a free cutting edge 16 configured to enable the perforation of the base wall or lateral wall of the support 4 during the relative movement of the tool 8, with respect to the positioning seat 5*a*, from the receded position to the advanced position, defining a hole 4*d* on said wall of the support 4. In fact, if the distal portion 9 has the free cutting edge 16, the same portion 9 essentially defines a perforating tool configured for making—during the movement of the tool 8—the hole 4*d* on the support. The hole 4*d* represents the passage of the support through which the distal portion passes in order to arrange—in the advanced position of the tool 8—at least part of the first and second through opening 11*a*, 11*b* in the reception volume.

The free cutting edge 16 is essentially defined by the first section of the closed continuous edge: the free cutting edge defines an open profile connected without interruption to the second and third section. As is visible from the enclosed figures, the free cutting edge 16 is defined exclusively on the front portion 10 of the distal portion 9 defining said first section: on the other hand, the second, third and fourth sections of the closed continuous edge are not sharp/cutting and essentially have the function of maintaining the hole open, ensuring that the one or more flaps possibly formed at the hole are maintained in open position.

The front portion 10 comprises a base 17, optionally flat, joined in a single piece to the base 13 of the intermediate portion 11 and emerging without interruption from the latter base 13: the base 17 of the front portion 10 is terminally delimited by an end part of the free cutting edge 16 having a shape substantially V-shaped, C-shaped or U-shaped. In more detail and as is visible in the enclosed figures, the front portion 10 comprises a first lateral cutting wall 18 and a second lateral cutting wall 19 opposite each other and emerging from the base 17 of the same front portion 10; the first and the second lateral cutting wall 18, 19 are joined as a single piece respectively as a continuation of the first and second lateral wall 14, 15 of the intermediate portion 11 (e.g. see FIGS. 11D and 13D).

The first and the second lateral cutting wall 18, 19 are joined as a single piece to the base 17, optionally flat, of the front portion 10. Base 17, first lateral cutting wall 18 and second lateral cutting wall 19 define—according to a view along the main extension direction of the distal portion 9—a shape with substantially C-shaped or substantially U-shaped open profile. The free cutting edge 16 delimits without interruption the first lateral cutting wall 18, the base 17 and the second lateral cutting wall 19 of the front portion 10. In particular, the free cutting edge 16 is joined without interruption to the respective free edges of the first and the second lateral wall 14, 15 of the intermediate portion 11.

As is visible for example in FIG. 11B, the free cutting edge 16 delimits the first and the second lateral cutting wall 18, 19; the free edges of the first and second lateral wall 14, 15 of the intermediate portion 11 are arranged at a pre-set distance d smaller than a maximum distance w between the free cutting edges of the first and second lateral cutting wall 18, 19 of the front portion 10.

In an embodiment variant of the penetrating tool 8, the latter lacks sharp/cutting portions: in other words, the penetrating tool does not have elements adapted to define a passage opening on the support for the crossing of the distal portion 9, since the opening or openings are made in the support in steps preceding the step of suctioning gas from the housing chamber. In such embodiment variant, the distal portion essentially comprises a penetration element lacking cutting elements; the apparatus 1 may therefore provide for such configuration of the penetrating tool 8, a perforation station 43 placed upstream of the packaging station 5 with respect to an advancement direction of the supports 4 (A1 in FIG. 1); the perforation station is configured for making one or more through openings or holes 4*d* on the supports 4, through which the distal portion 9—lacking cutting elements—can pass in order to reach the reception volume for the product.

As described above, the packaging station 5 is configured for sealingly constraining the film portion 6 to the support 4 in order to define a housing chamber C for the product P. The suctioning system 21 is associated with the penetrating tool 8 and is configured for removing air—through the first and second through opening 11*a*, 11*b* in the advanced position of the penetrating tool 8—both from the reception volume and, once the housing chamber is formed, also from the housing chamber C, thereby the maximum formation of vacuum is ensured, and consequently the film portion can closely adhere to the product P and to the upper surface of the support, forming an actual hermetic closure skin for the product on the support. In more detail, the penetrating tool 8 is suitable to operate inside said housing chamber T and to cooperate with one or more supports engaged in the seat 5*a* of the station 5. As described above, the suctioning system 21 comprises:

at least one vacuum pump 22, at least one suctioning channel 23 adapted to place the vacuum pump in fluid communication with the fluid-tight packaging chamber definable by the packaging station 5.

The first and the second through opening 11*a*, 11*b*—in advanced position condition of the penetrating tool 8 and in the second operating condition of the packaging station 5—are in direct fluid communication with the housing chamber T and hence—through the suctioning channel 23—with the vacuum pump 22. The vacuum pump 22, upon control of the control unit 24, is configured to enable the removal of air in the housing chamber C for the product P—through the first and second through openings 11*a*, 11*b*—by means of air suction from the housing chamber T of the packaging station 5.

As described above, the apparatus may comprise a control unit 24; such unit can be advantageously connected to the packaging station 5 and to the penetrating tool 8. The control unit 24 is configured to:

control the positioning of the penetrating tool 8 in the advanced position once one or more supports are engaged in the seat 5*a*, control the packaging station 5 for sealingly constraining the film portion 6 to the respective support 4, control the suctioning system 21 to determine the removal of air from the housing chamber T and possibly from the housing chamber C.

In particular, the control unit 24 is configured to:

control the packaging station in order to bring the tools into the first operating condition of the packaging station; for such purpose, it is observed that the control unit can act on one or more actuators of hydraulic, electrical or pneumatic type, for example carried by the frame 10 and active on one or on both upper and lower tools.

once the first operating condition of the station 5 has been attained, control the movement of the conveyor 3 so that at least one support 4 is positioned in a respective seat 5*a* of the station 5, as well as control the system for driving the film or the precut discrete sheets so as to position a film portion in the packaging station and above the respective support, control the positioning of the penetrating tool 8 in the advanced position once one or more supports are engaged in the seat 5*a*, following the positioning of the support in the seat 5*a*, control the packaging station in order to bring said upper and lower tools into the second operating condition, in a manner such to define the hermetically closed housing chamber T.

following the closure of the chamber T, control the suctioning system 21 to remove air from the chamber T; this step can also occur through the first and second opening of the penetrating tool, control the packaging station 5 for sealingly constraining the film portion 6 to the respective support 4, control the suctioning system 21 to continuously remove air—through the first and second through opening of the penetrating tool 8—also following the sealing constraint of the film portion 6 on the support 4 in a manner so as to substantially remove gas from the housing chamber C for the product.

Figure 10:
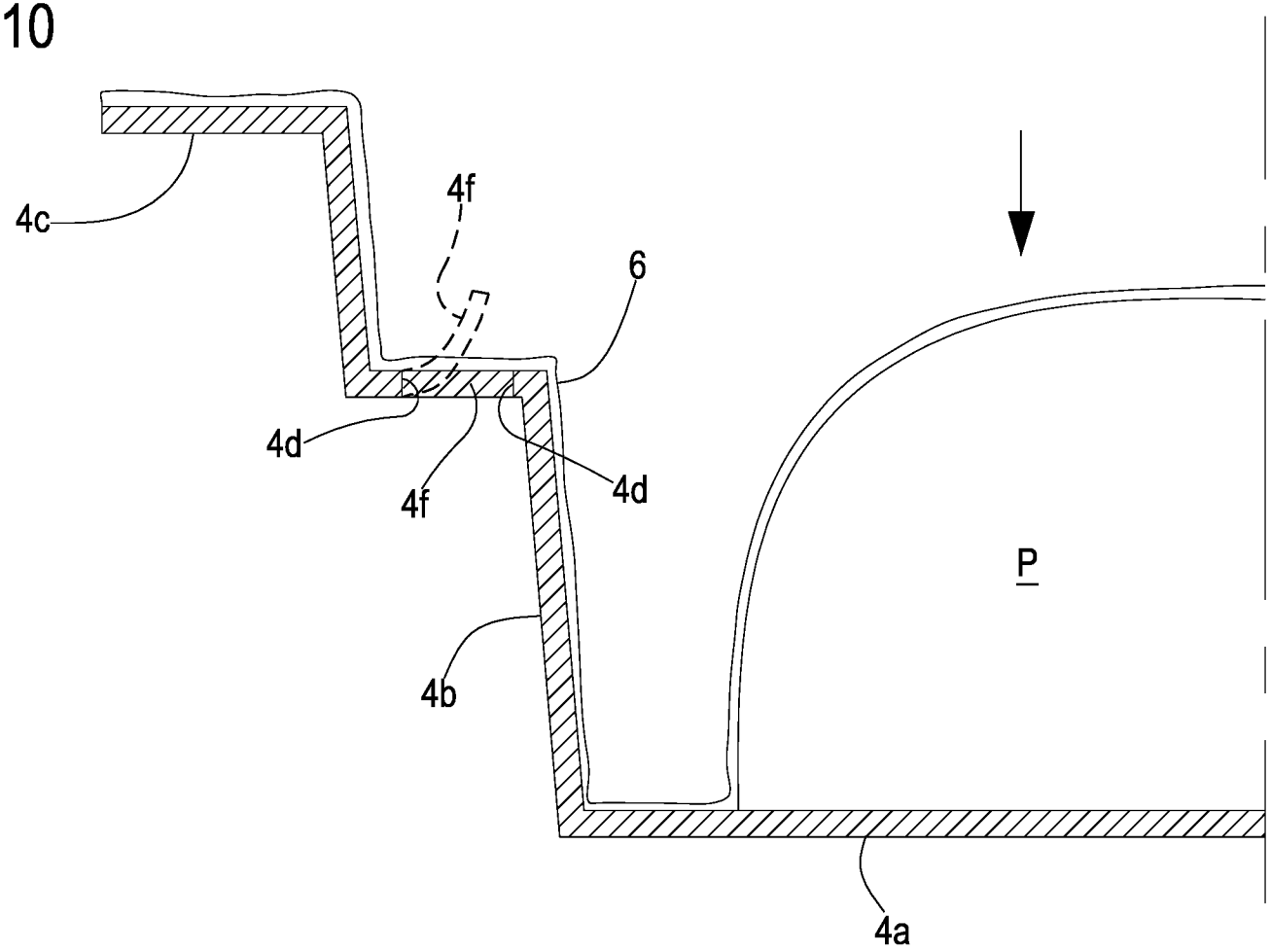

The control unit—during or immediately after the end of the air suction from the housing chamber T and from the housing chamber C for the product—is configured to control the movement of the penetrating tool from the advanced position to the receded position so that the film portion can act on the opening flap 4*f* and close the through opening or hole 4*d* (FIG. 10).

Packaging Method

After that described above from a structural sense, a packaging method according to the invention is described hereinbelow. The method described herein preferably uses the above-described apparatus 1 claimed in one or more of the enclosed claims. It should also be observed that, in accordance with a further aspect of the invention, the various method steps described hereinbelow can be carried out under the control of the control unit 24, which acts on suitable actuators and/or motors and/or pumps and/or valves in order to achieve the various described steps and on one hand determine the movements of the various movable parts and on the other hand control the suction and/or the injection of gas from the/into the housing chamber.

The packaging method according to the invention provides for moving one or more supports 4 on which at least one respective product P is arranged along the pre-set advancement path A, up to the packaging station 5, as well as for moving at least one portion of a film 6 up to the same packaging station 5: in order to enable the access of the film portions and of the supports in the packaging station, this is suitably maintained in the first operating condition in order to then be closed and brought into the second operating condition once the one or more supports and respective one or more film portions are suitably positioned in the packaging station. The control unit in addition to controlling the just-described movements suitably synchronizes the stepping motion of the trays, the stepping motion and the passage of the packaging station from the first to the second operating condition and vice versa.

Entering into further detail, the packaging method provides for receiving at least one support 4 in the packaging station 5, at a respective positioning seat 5*a*, and receiving at least one portion of a film 6 which is arranged above and vertically aligned with said at least one support so that, between said support and said film portion, a reception volume is defined where said product P to be packaged is located.

As already mentioned, once the positioning of the support and the film portion in the packaging station has been completed, the method provides for positioning the penetrating tool 8 in the advanced position in which a part of the tool 8 crosses the base wall or the lateral wall of the support 4 arranged in said positioning seat, accessing the reception volume for the product.

It is observed that provision is preferably made such that it is the penetrating tool to be moved with respect to the lower tool, even if alternatively the opposite could be provided, so long as a relative movement between the penetrating tool and the positioning seat is attained. In the illustrated embodiments, the step of positioning the penetrating tool in the advanced position comprises moving the penetrating tool from the receded position to the advanced position: during said movement the penetrating tool perforates the base wall or the lateral wall of the support, forming at least one hole 4*d* through which the penetrating tool is arranged: at the hole 4*d*, the penetrating tool can form one or more flaps 4*f*, foldable and constrained to edge portions of the hole 4*d*. The hole can have circular shape, triangular shape, polygonal shape, elliptical shape or still another shape in accordance with the geometry of the penetrating tool.

It should be observed that, in accordance with one aspect of the invention, once the penetrating tool is situated at the advanced position, such penetrating tool 8 has the first through opening arranged at least partly inside the reception volume for the product, beyond said base wall or beyond said lateral wall, and simultaneously has the second through opening arranged astride said base wall or said lateral wall.

The packaging method then provides for, preferably upon control of the control unit 24, the steps of extracting gas at least from the reception volume for the product through said first and said second opening, and of sealingly constraining the film portion 6 to said support 4. The constraining step occurs for example by means of heat-welding the film to the respective support following a suitable heating of the film and/or of the support by the packaging station. However, it is possible that the constraining step can alternatively occur via gluing, upon application of suitable adhesives at the zone of mutual contact between film and support.

It should be observed that the step of constraining the film portion 6 to the support 4 comprises sealingly constraining the film portion with at least one perimeter edge of the support 4 in order to define a housing chamber C for the product P: for example, the film portion can adhere to the perimeter edge of the support and to the upper surface of the support not occupied by the product. The suctioning step provides for controlling the suctioning system 21 to remove air from said housing chamber C—through the first and second through opening 11*a*, 11*b*—also after having sealingly constrained the film portion to the perimeter edge of the support, in a manner such that the film can closely unite with the surface of the product and of the support, adhering to the latter like a skin.

As described above, the penetrating tool 8 is associated with the packaging station 5 and is suitable to operate inside said housing chamber T: in particular the suction of gas from the housing chamber is carried out when such chamber is formed and hermetically closed, after having brought the upper tool and lower tool into said second operating condition. In such second operating condition, the penetrating tool is brought into the advanced position thereof in a manner such that the first and the second through opening 11*a*, 11*b* are in direct fluid communication with the housing chamber T and hence—through the suctioning channel 23—with the vacuum pump 22. According to one aspect, the method provides for controlling the vacuum pump 22 and removing gas—through the first and second through opening 11*a*, 11*b*—also by suctioning air from said reception volume (when the film portion is not yet sealingly constrained with at least one perimeter edge of the respective support) and hence, upon fixing the film portion to the respective support, from the housing chamber C for the product, as stated leading to a maximization of the vacuum effect. Once the desired removal of gas has been carried out, the packaging method comprises the step of returning the penetrating tool into the receded position, enabling the film portion to adhere to a surface of the perforated lateral wall or base wall, hermetically sealing the hole 4*d*. Following the step of returning the penetrating tool into the receded position, the possible one or more flaps 4*f* are moved to close the hole 4 and in alignment with said base wall or said lateral wall of the support: in particular, the film portion adheres to a surface of said perforated lateral wall or base wall, also blocking said one or more flaps perfectly aligned with the respective wall to close the hole.

After this, provision is made to bring the upper tool and the lower tool into said first operating condition, and to extract the packaged product from the packaging station. It is observed that the step of returning the penetrating tool into the receded position occurs after having sealingly constrained the film portion to the perimeter edge of the support and preferably once the gas extraction step has terminated. It should also be observed that the step of returning the penetrating tool into the receded position occurs after a pre-set period of time from the beginning of the suctioning step or upon reaching a pre-set vacuum level in the housing chamber (detectable by suitable pressure sensors present in the housing chamber and connected with the control unit). Once the packaged product has been extracted from the housing chamber, a new packaging method can be carried out by repeating the above-described steps.

The invention claimed is:

1. An apparatus for packaging a product arranged on a support, the apparatus comprising:

a frame, a conveyor engaged to the frame and configured to move one or more supports along a pre-set advancement path, a packaging station configured to:

receive a support at a respective positioning seat, the support comprising a base wall, receive a portion of a film above the support so that, between the support and the film portion, a reception volume is defined for the product, sealingly constrain the film portion to the support, the packaging station comprising a penetrating tool being configured to be arranged in at least one advanced position in which a part of the tool crosses the base wall or a lateral wall of a support arranged in the positioning seat, accessing the reception volume, wherein the penetrating tool has at least one first through opening and at least one second through opening distinct and separate from each other, and wherein the penetrating tool is configured to have, at the advanced position:

the first through opening arranged at least partly in the reception volume, beyond the base wall or beyond the lateral wall, characterized by the fact that the penetrating tool is configured to have, at the advanced position, the second through opening arranged astride the base wall or the lateral wall.

2. The apparatus of claim 1, wherein the second through opening—in the advanced position of the penetrating tool—partly extends into the reception volume, beyond the base wall or beyond the lateral wall, and partly outside the reception volume.

3. The apparatus of claim 1, wherein the penetrating tool comprises a distal portion which—in the advanced position of the penetrating tool—is suitable to be arranged at least partly in the reception volume, wherein the first and the second through openings are defined at the distal portion, wherein the distal portion has a shape elongated along a main extension direction and it comprises:

a front portion, a rear portion, an intermediate portion interposed between the front portion and the rear portion, wherein the front portion, when the penetrating tool is in advanced position, is arranged in the reception volume while the intermediate portion is arranged astride the base wall or the lateral wall.

4. The apparatus of claim 3, wherein the second through opening at least partly extends on the intermediate portion, and wherein the first through opening extends along the entire longitudinal extension of the front portion and the intermediate portion.

5. The apparatus of claim 3, wherein the front portion and the intermediate portion are joined as a single piece and are arranged one immediately after the other according to the main extension direction of the distal portion, wherein the second through opening is defined by a single opening perimetrically delimited by a single closed continuous edge, and wherein the intermediate portion has—according to a section defined at the first through opening and transverse to the main extension direction of the distal portion—an open profile.

6. The apparatus of claim 3, wherein the intermediate portion comprises:

a base, a first and a second lateral wall emerging from the base starting from opposed perimeter edges of the latter, the first and second lateral walls being connected to each other exclusively by the base, and wherein the first and second lateral walls have—on the opposite side with respect to the base—respective free ends at least partly delimiting the first through opening.

7. The apparatus of claim 6, wherein the second through opening is defined on the base of the intermediate portion, and wherein the base of the intermediate portion is flat or slightly convex and it has a substantially rectangular shape, the second through opening extending along the entire extension of the base—according to the main extension direction of the distal portion.

8. The apparatus of claim 1, wherein the first through opening has a closed continuous edge comprising:

a first section defining a cutting end, with a single tip or multiple tips, of the front portion, a second and a third section, mutually parallel and emerging from ends of the first section, a fourth section transverse to the second and third section which connects ends of the second and third section axially opposed to the first section, the sections conferring, to the closed continuous edge, a shape that is non-planar and extended along the longitudinal extension of the penetrating tool, and wherein the first through opening is defined by a single opening perimetrically delimited by the closed continuous edge.

9. The apparatus of claim 1, wherein the penetrating tool is movable with respect to the positioning seat of the same packaging station between:

a receded position in which the penetrating tool is arranged outside the reception volume spaced from or in contact with the base wall or the lateral wall of the support, and the advanced position, wherein a distal portion of the penetrating tool comprises a free cutting edge configured to enable the perforation of the wall of the support during the relative movement of the tool, with respect to the positioning seat, from the receded position to the advanced position, defining a hole on the wall of the support.

10. The apparatus of claim 1, wherein the packaging station is configured to sealingly constrain the film portion to the support to define a chamber for housing the product, wherein the apparatus comprises a suctioning system associated with the penetrating tool, the suctioning system being configured to remove air—through the first and second through opening in the advanced position of the penetrating tool—from the housing chamber.

11. The apparatus of claim 10, further comprising a control unit connected to the packaging station and to the penetrating tool, the control unit being configured to:

control the positioning of the penetrating tool in the advanced position, control the packaging station to sealingly constrain the film portion to the respective support, control the suctioning system to determine the removal of air from the housing chamber.

12. The apparatus of claim 11, wherein the control unit is configured to control the suctioning system to continuously remove air—through the first and second through opening of the penetrating tool—also following the sealing constraint of the film portion on the support.

13. The apparatus of claim 12, wherein the control unit is also configured to:

control the movement of the upper and lower tool mutually approaching each other to define the second operating condition, subsequently, control the suctioning system to remove at least part of the air present in the packaging chamber in order to therein define a pressure lower than the atmospheric pressure, control the packaging station to sealingly constrain the film portion on the support, and following the sealing constraint, control the continuous removal of air from the packaging chamber.

* * * * *